US012540519B2

(12) United States Patent
Silva

(10) Patent No.: US 12,540,519 B2
(45) Date of Patent: Feb. 3, 2026

(54) RETRIEVABLE PACKER CAPABLE OF OPERATING IN THE CURVE AND HORIZONTAL OF A WELLBORE

(71) Applicant: Royal Completion Tools, LLC, Houston, TX (US)

(72) Inventor: Zachary Silva, Houston, TX (US)

(73) Assignee: Royal Completion Tools, LLC, Houston, TX (US)

( * ) Notice: Subject to any disclaimer, the term of this patent is extended or adjusted under 35 U.S.C. 154(b) by 0 days.

(21) Appl. No.: 18/220,821

(22) Filed: Jul. 11, 2023

(65) Prior Publication Data

US 2024/0011362 A1 Jan. 11, 2024

Related U.S. Application Data

(60) Provisional application No. 63/368,105, filed on Jul. 11, 2022.

(51) Int. Cl.
*E21B 23/06* (2006.01)
*E21B 33/128* (2006.01)

(52) U.S. Cl.
CPC ..... *E21B 23/06* (2013.01); *E21B 33/128* (2013.01)

(58) Field of Classification Search
CPC ..... E21B 23/01; E21B 23/06; E21B 33/128; E21B 33/129
See application file for complete search history.

(56) References Cited

U.S. PATENT DOCUMENTS

| | | | | |
|---|---|---|---|---|
| 5,335,737 | A * | 8/1994 | Baugh | E21B 7/061 175/81 |
| 5,542,473 | A * | 8/1996 | Pringle | E21B 33/129 166/134 |
| 9,637,985 | B2 * | 5/2017 | Scott | E21B 33/12 |
| 2006/0219413 | A1 * | 10/2006 | Vilela | E21B 17/07 166/242.7 |
| 2010/0101807 | A1 * | 4/2010 | Greenlee | E21B 33/1295 166/387 |
| 2013/0014951 | A1 * | 1/2013 | Fitzpatrick | E21B 43/26 166/305.1 |
| 2020/0248520 | A1 * | 8/2020 | Johnsen | E21B 31/18 |
| 2022/0090465 | A1 * | 3/2022 | Petrowsky | E21B 34/103 |
| 2023/0184052 | A1 * | 6/2023 | Newberry | E21B 33/1208 166/386 |

* cited by examiner

*Primary Examiner* — Robert E Fuller
(74) *Attorney, Agent, or Firm* — Compass IP Law PC

(57) ABSTRACT

A wellbore packer can be deployed and easily retrieved within a wellbore of vertical or horizontal orientation or in a transition orientation. The packer includes a bottom sub on a downhole portion and a shear sub within an inner cavity of the bottom sub. The shear sub has a depression in a wall of the shear sub, which aligns in a set position of the packer with a threaded hole through a wall of the bottom sub. The packer includes a body to extend from an uphole portion of the packer to the shear sub, the body secured to the shear sub. The threaded hole supports variable shear strength shear screws where, in response to increased uphole tensile force on the body, the shear sub is to shear the shear screw and move uphole relative to the bottom sub, and unset the wellbore packer from the set position.

16 Claims, 13 Drawing Sheets

RETRIEVABLE PACKER CAPABLE OF OPERATING IN THE CURVE AND HORIZONTAL OF A WELLBORE

TECHNICAL FIELD

Descriptions are generally related to drilling, and more particular descriptions are related to wellbore packers.

BACKGROUND OF THE INVENTION

When a wellbore for hydrocarbon retrieval is initiated, there is typically uphole pressure from the reservoir. As the natural drive of the near wellbore formation begins to decline, oil and gas wells utilize multiple remedial production methods to artificially drive hydrocarbons from the reservoir to surface equipment. Of these methods, a common solution has been the installation of electric submersible pumps (ESPs), which are installed within the wellbore, and in the case of unconventional wells, they can be installed directly above the kick-off point to the start of the wellbore curve into the lateral.

It is not uncommon for an ESP to fail while a well is still producing hydrocarbons, which prompts the need to clear the failed ESP from the wellbore to bring the well back to production. When an ESP fails in the field, there is a risk the ESP will break away from its anchor point within the wellbore and fall until resting at the bottom of the well, or in the case of wells with horizontal laterals, fall until resting somewhere within the curve to the horizontal portion of the well. When this occurs in wells with lateral sections, the fishing operation to remove the fallen ESP that is resting within the curved portion of the wellbore is extremely difficult and costly, which results in undue expense to the operator and unnecessary risk to assets and personnel on location.

To mitigate the fishing risks for failed ESPs, there can be a form of repurposed retrievable production packers or cast-iron bridge plugs employed as ESP catchers, which are currently available as surplus inventory items. When utilizing production packers as ESP catchers in unconventional wells with laterals, they are required to be set within the curve of the wellbore to allow the ESP to be set as low in the vertical as possible. Setting repurposed production packers as ESP catchers low in the vertical involves setting a part that is not intended to be set or retrieved in curved wellbores. The attempt to use the production packers in such environments invariably provides challenges when attempting to retrieve or fish the production packers out to retrieve a failed ESP. When utilizing cast iron bridge plugs, the result is almost guaranteed that the bridge plug will fail upon ESP impact as well, which compounds the fishing difficulty, risk, and expense to retrieve the ESP.

BRIEF DESCRIPTION OF THE DRAWINGS

The following description includes discussion of figures having illustrations given by way of example of an implementation. The drawings should be understood by way of example, and not by way of limitation. As used herein, references to one or more examples are to be understood as describing a particular feature, structure, or characteristic included in at least one implementation of the invention. Phrases such as "in one example" or "in an alternative example" appearing herein provide examples of implementations of the invention, and do not necessarily all refer to the same implementation. However, they are also not necessarily mutually exclusive.

Descriptions of certain details and implementations follow, including non-limiting descriptions of the figures, which may depict some or all examples, and well as other potential implementations.

DETAILED DESCRIPTION OF THE INVENTION

As described herein, a wellbore packer designed to be deployed and easily retrieved within a wellbore of vertical orientation, horizontal orientation, or any curve between the vertical and horizontal orientation of the wellbore. The wellbore packer described enables selective isolation and reopening of the wellbore for production. The wellbore packer has sufficient resilience to withstand the impact of a falling electric submersible pump (ESP) without becoming unset and falling further down the wellbore.

The stability of the packer reduces or eliminates the chance for misruns when attempting to retrieve the packer below the vertical portion of the wellbore, while also reducing or eliminating the need to fish failed ESPs from the regions of the lower wellbore. Additionally, the packer described allows for variable load requirements when retrieving the packer. The ability to accommodate variable loads enables configuration for varying wellbore depths, for different weight of tubing needed to reach the target depth, and for different pulling limitations of the surface equipment during retrieval operations.

Structurally, the packer includes a bottom sub on a downhole portion of the packer and a shear sub within an inner cavity of the bottom sub. The inner cavity is an opening of the bottom sub having a cylindrical cross section. The bottom sub includes a threaded hole through a wall of the bottom sub. The shear sub has a depression in a wall of the shear sub, the depression to align in a set position of the packer with the threaded hole of the bottom sub. The packer has a body that extends from an uphole portion of the packer to the shear sub, the body secured to the shear sub. The threaded hole supports variable shear strength shear screws where, in response to increased uphole tensile force on the body, the shear sub is to shear the shear screw and move uphole relative to the bottom sub, and unset the wellbore packer from the set position. Thus, the packer can accommodate the variable loads as described above.

The packer described can be employed as an inverted packer apparatus for use in temporarily isolating a wellbore during remedial ESP installation, with the ability to reopen the wellbore for production throughout the life of the ESP. The packer can ultimately serve as a landing point for the ESP should it fail throughout its operation, which prevents a difficult and costly removal operation to clear the wellbore of the failed ESP and auxiliary components.

Figure 1:
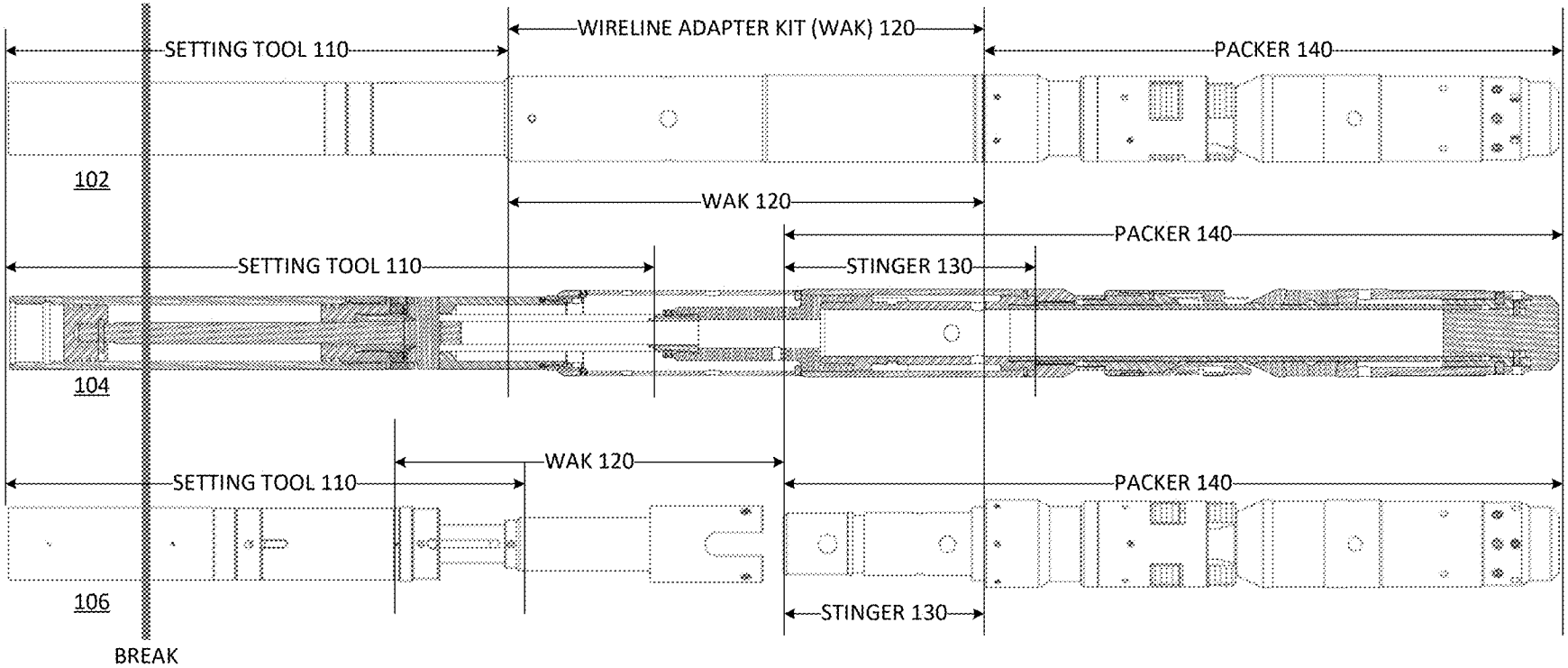
FIG. 1 is a block diagram of an example of a system to set a wellbore packer.

FIG. 1 is a block diagram of an example of a system to set a wellbore packer. The dark vertical line represents a horizontal break in the diagram, cutting across all views. The break indicates that the component could have greater length than what is illustrated.

View 102 illustrates an "outside" view of the assembly/system. Setting tool 110 is the most "uphole" component, referring to a component closest to a ground level opening of the wellbore. Thus, setting tool 110 can be the last component to enter the wellbore, after the other components.

Setting tool 110 connects to tubing and other lines (not illustrated), which are coupled to surface equipment. The connection can be directly to equipment above ground, or through other components not illustrated to equipment that is above ground. Setting tool 110 extends to wireline adapter kit (WAK) 120.

WAK 120 extends from setting tool 110 to packer 140. Packer 140 represents a bidirectional slip anchor in accordance with any description herein. Packer 140 can be referred to as a wellbore packer. Packer 140 is at the downhole end of the assembly.

View 104 illustrates a cutaway view of some of the components. It can be seen that setting tool 110 includes internal mechanisms/components to detachably connect to WAK 120. In one example, WAK 120 includes a shear release, such as a shear screw, to allow setting tool 110 to shear away from WAK 120.

WAK 120 can include a setting sleeve and a tension mandrel. The setting sleeve extends from the internal mandrel of setting tool 110 to the tension mandrel of WAK 120, which in turn connects to stinger 130. In one example, stinger 130 is considered part of packer 140. View 102 does not illustrate stinger 130, which is within WAK 120. View 104 illustrates stinger 130 within WAK 120 and connected to the other components of packer 140.

View 106 illustrates internal components of setting tool 110 and WAK 120, before being engaged with stinger 130. Setting tool 110 connects to the tension mandrel of WAK 120, which has slots that engage with lugs on the outer surface of stinger 130. In one example, the slots enable selectively engaging WAK on and off stinger 130. Thus, setting tool 110 and WAK 120 can be considered an on/off tool to engage with packer 140 to set the packer and later to retrieve the packer.

Figure 2:
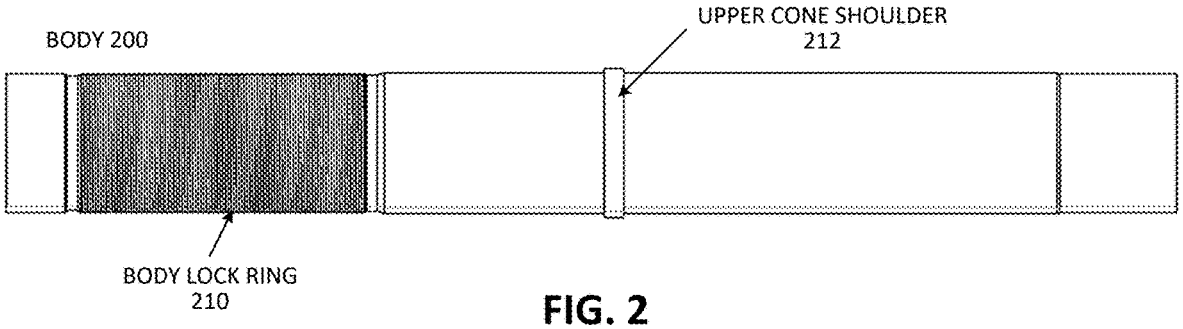
FIG. 2 is a block diagram of an example of a packer body.

FIG. 2 is a block diagram of an example of a packer body. Body 200 represents a body of the packer, such as packer 140 of view 102, view 104, and view 106. Body 200 represents an internal mandrel of the packer. The outer components of the packer can be assembled onto the body component.

Mechanically, the body can serve to hold the outer components in place, relative to the stinger on uphole end, and the shear sub on downhole end. Thus, the stinger can be connected to the uphole end of body 200, and the shear sub can be connected to the downhole end. From a load case perspective, during specific operations (e.g., setting, retrieval, or other operations), body 200 ensures that the load is transmitted completely through the components of the packer.

Consider the setting load path. The wireline adapter kit tension mandrel holds the stinger in place, effectively anchored relative to the moveable parts of the packer. Body 200 is fixed to the stinger, and the shear sub is fixed to body 200. When the setting event begins, a setting sleeve from the WAK moves downhole relative to the tension mandrel of the WAK and makes contact with the body lock support ring. Body 200 illustrates body lock ring (BLR) 210, which engages with the body lock support ring.

The compressive load is transmitted into all of the outer components until the bottom sub, at which point the load path goes through the shear screws that anchor the bottom sub to the shear sub. Reference in the descriptions will generally be made to shear screws, which provide variable shear strength to the packer described. It will be understood, as is described in more detail below, that a different shear release could be used alternatively to shear screws. After going through the outer components to the bottom sub, the load path moves into the inner parts, which are in tension because the stinger, body 200, and the shear sub are being push away from their anchor point above the stinger.

Body 200 illustrates upper cone shoulder 212, which refers to a structural feature of the body that enables the upper cone to shoulder against the body. Shouldering refers to contacting a structure or feature that resists the movement of one component relative to the other component, effectively causing the components to move as an assembly. Thus, the upper cone can move relative to body 200 until engaging with upper cone shoulder 212, and when shouldered, the upper cone and body 200 will move together.

Body 200 can be considered to have three distinct regions. The regions can be a buttress thread represented by body lock ring 210, upper cone shoulder 212, which represents a retrieval ring on outer surface of the body, and the seal diameter. The seal diameter refers to the ends of body 200, which include the uphole end and the downhole end. In one example, these ends are threaded to thread onto structural elements.

Figure 3:
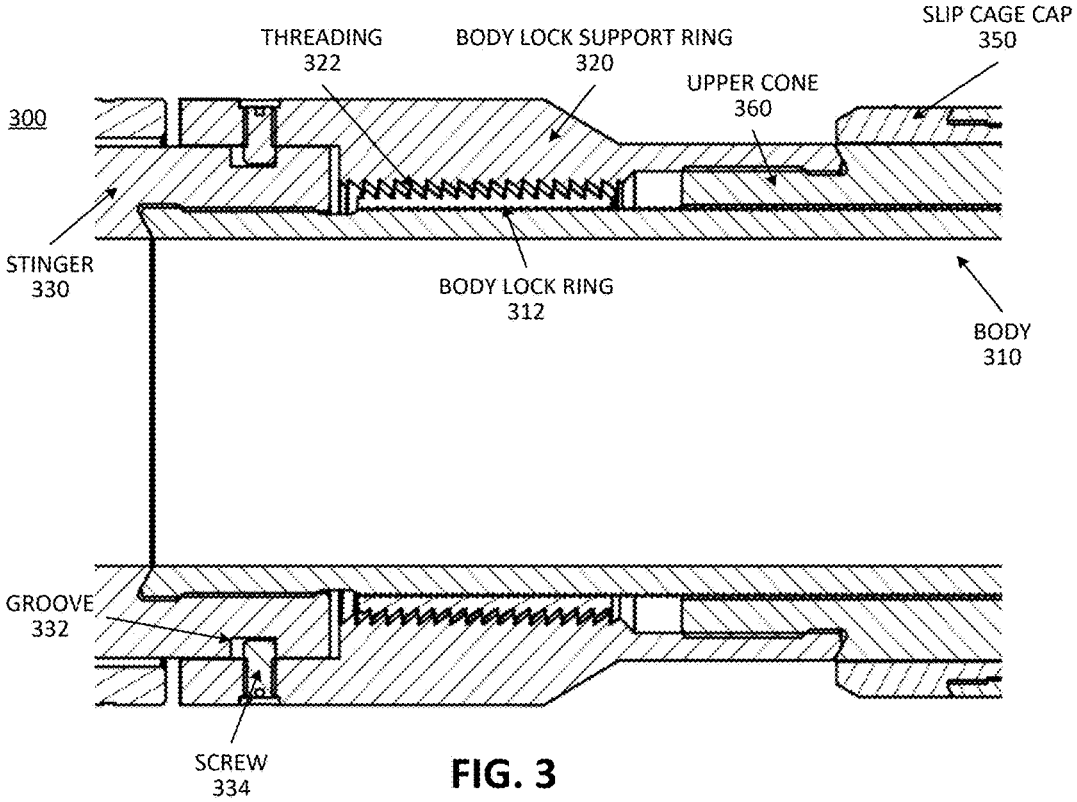
FIG. 3 is a cutaway diagram of an example of ratcheting threading of a packer.

FIG. 3 is a cutaway diagram of an example of ratcheting threading of a packer. Assembly 300 illustrates a cutaway of a portion of a packer. Stinger 330 can be seen on the uphole portion of assembly 300, which engages with body 310. Body 310 includes body lock ring (BLR) 312 on an outside surface of the body. Outside BLR 312 is an outer component, body lock support ring 320, which can surround body 310. Body lock support ring 320 includes threading 322 to engage with, and ratchet against the threading of BLR 312.

Assembly 300 also illustrates slip cage cap 350, which surrounds upper cone 360, which is around body 310. In one example, stinger 330 includes groove 332 to receive a head of screw 334. Groove 332 represents a depression in the outer surface of stinger 330 to engage with a shear release of body 310. Screw 334 represents the shear release for assembly 300. When force lower than the shear load threshold of screw 334 is applied, stinger 330 will be secured to body 310. When sufficient force is exerted on screw 334, the screw will shear off, releasing stinger 330 from body 310.

The engagement of threading 322 with BLR 312 can provide a buttress thread that serves as a ratcheting mechanism for the body lock ring. The thread allows BLR 312 to translate in the righthand direction by ratcheting/snapping over each of the thread teeth, but prevents any travel in the lefthand direction due to the 90 degree face on that side of the thread. For a packer design that utilizes only one set of slips on one side of the element, such a design can prevent the element from unsetting the packer once set. The component could be thought of as a spring, which has the ability to compress. However, it will want to decompress back to its original state, and thus is can expand to the casing inner diameter to form a seal. Having a body lock ring will mechanically hold the components relative to the packer body wherever the setting distance ends. The mechanical hold can be limited to be only in the one direction relative to the thread teeth.

Figure 4:
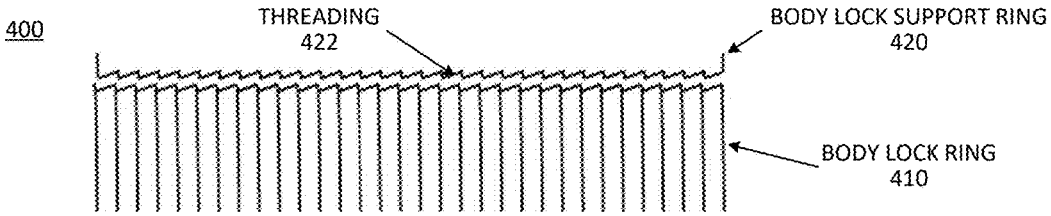
FIG. 4 is a block diagram of an example of ratcheting threading for a packer.

FIG. 4 is a block diagram of an example of ratcheting threading for a packer. Assembly 400 illustrates a close-up of the engagement of the body lock ring with the teeth of the threading of the body lock support ring, such as illustrated in assembly 300.

The top portion represents body lock support ring 420, and the bottom portion represents the threading of body lock ring 410. Body lock support ring 420 includes threading 422 with threading teeth. Body lock ring 410 also includes threading with teeth, which engage with threading 422 to provide a ratcheting effect.

Figure 5:
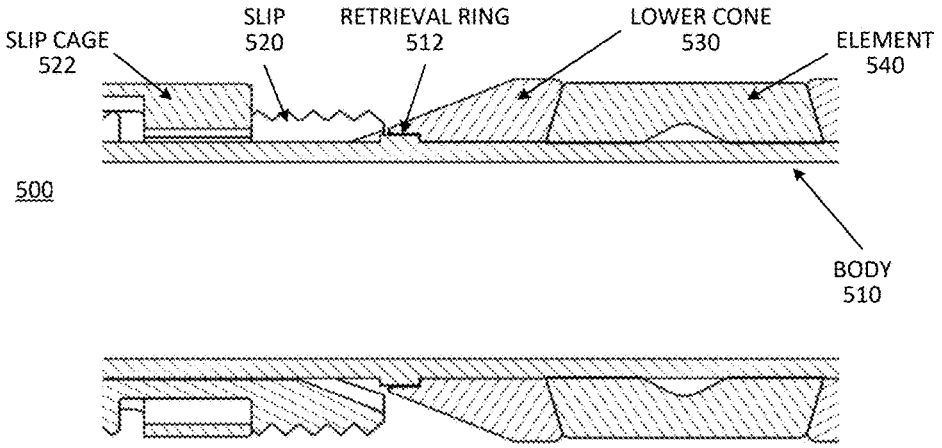
FIG. 5 is a cutaway diagram of an example of slip assembly of a packer.

FIG. 5 is a cutaway diagram of an example of slip assembly of a packer. Assembly 500 illustrates a middle portion of the packer body. Body 510 represents the packer body. Assembly 500 illustrates a retrieval ring towards the middle of the body. As mentioned previously, the retrieval ring represents a structural component of body 510 that engages other components. More specifically, lower cone sets against a structure on the outer surface of body 510.

Assembly 500 illustrates element 540, which represents a compressive element on the outside diameter of body 510. Assembly 500 illustrates lower cone, which can engage with slip 520. Slip cage 522 surrounds slip 520. Retrieval ring 512 represents the structure on body 510.

Retrieval ring 512 can serve multiple purposes. One purpose is that during assembly, retrieval ring provides a mechanical locating feature for installing lower cone 530, which in turn mechanically locates the installation of the parts below lower cone 530 (e.g., element 540 and the bottom sub). Another purpose is that during retrieval, when body 510 is pulled in the uphole direction, retrieval ring 512 contacts the upper slip and imparts the pulling load into the upper slip, continuing the retrieval event.

Figure 6A:
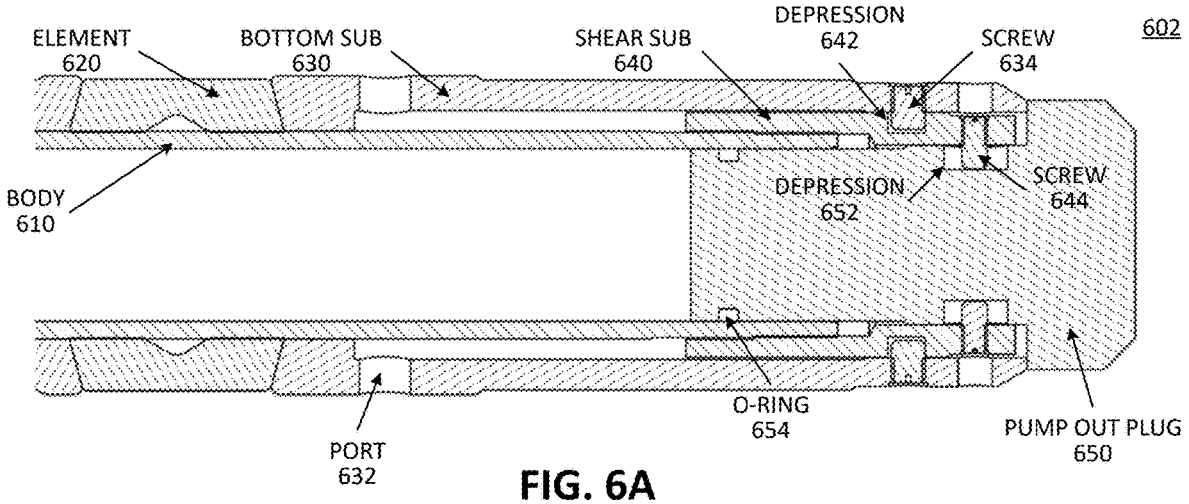
FIGS. 6A-6B are cutaway diagrams of an example of a shear screw assembly for a packer.
Figure 6B:
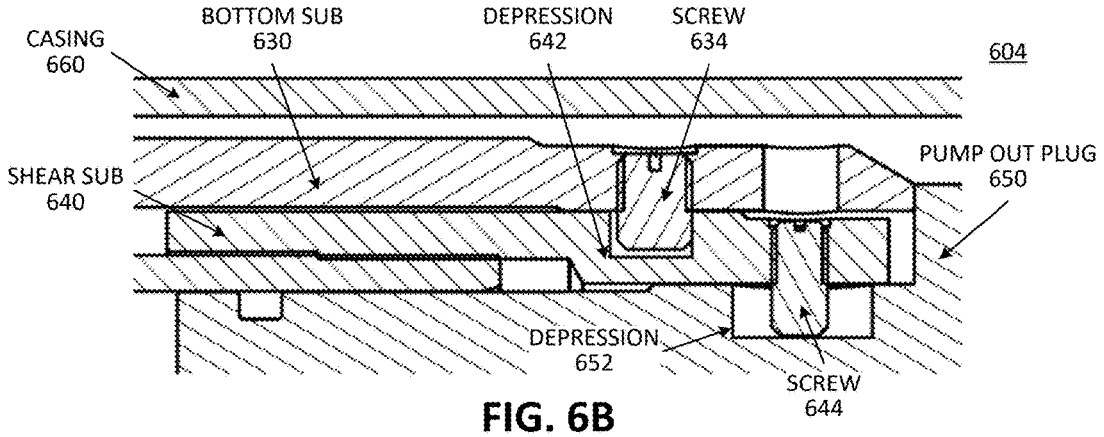

FIGS. 6A-6B are cutaway diagrams of an example of a shear screw assembly for a packer. Referring to FIG. 6A, assembly 602 represents an assembly of the downhole portion of a packer in accordance with any description herein.

Assembly 602 illustrates body 610, which connects to pump out plug 650. Element 620 represents a compressive element assembly on an outer diameter of body 610. Bottom sub 630 represents a bottom portion of the packer, which can move up and down the outer diameter of body 610. Bottom sub 630 can contact the downhole side of element 620.

Shear sub 640 represents a component that can move relative to body 610 and move relative to bottom sub 630. Shear sub 640 can be secured to body 610 and to bottom sub 630 with shear releases to allow the components to be assembled together for certain operations, and then to release for other operations.

In one example, bottom sub 630 includes port 632, which represents ports or openings in the structure of bottom sub 630 to enable fluid (e.g., liquid or gas) to pass through. In one example, body 610 engages with pump out plug 650 with O-ring 654. O-ring 654 has a tensile force that can be exceeded by a build-up of uphole pressure, which can expel pump out plug 650 from body 610.

Pump out plug 650 can include depression 652 to receive a head of screw 644, which represents a shear screw. Alternatively, depression 652 could receive a different type of shear release. Screw 644 can secure pump out plug 650 to shear sub 640. In one example, when sufficient force is applied downhole to pump out plug (e.g., a force from uphole), screw 644 will shear off, releasing the connection to shear sub 640.

In one example, shear sub 640 includes depression 642 in its outer surface/outer diameter to receive a head of screw 634. Screw 634 represents another shear release screw for assembly 602. In response to uphole tension (e.g., tension pulling uphole), screw 634 can shear off, releasing shear sub 640 from bottom sub 630. Shear sub 640 and bottom sub 630 can be attached with screw 634, restricting them from moving relative to each other. When screw 634 is sheared off, shear sub 630 can move relative to bottom sub 630.

In one example, body 610 has a seal diameter below the retrieval ring, where the surface is a seal finish to ensure that the element not only seals against the casing inner diameter, but that it also holds a seal against the body outer diameter. The seal can effectively isolate pressure above and below the packer.

In one example, the uphole end and the downhole end of body 610 are threaded ends. The threading can be different from standard threads, such as the buttress thread discussed above. In one example, pump out plug will be expelled with the application of pressure the uphole side of the packer. The pressure acts on the O-ring on the pump out plug to push it out like a piston.

In one example, pressure on the downhole side acts on pump out plug 650. The pressure pushes pump out plug to the left (uphole), at which point pump out plug 650 shoulders on bottom sub 630. Shouldering here prevents the shear screws from being loaded when pressure is seen from the downhole side, which prevents shearing screws 644 due to pressure in the uphole direction. The shouldering can also prevent pressure from acting on shear sub 640, preventing the uphole pressure shearing screws 634 until pump out plug 650 has been expelled.

In one example, the slots for the shear screws are elongated to enable movement of pump out plug 650 without touching the shear screws when the pump out plug moves to the left (uphole). Pressure from uphole (movement to the right) can shear the screws and expel pump out plug 650 when the pressure threshold is exceeded.

Referring to FIG. 6B, assembly 604 illustrates a close-up view of the shear release (shear screws in this assembly). Assembly 604 illustrates casing 660, which represents the casing wall of the wellbore. Assembly 604 also illustrates shear sub 640, bottom sub 630, pump out plug 650, depression 652, screw 644, depression 642, and screw 634, all of which are described above.

In one example, shear sub 640 connects the packer body to the rest of the outer parts. During assembly shear sub 640 can control the installation distance of the outer sub and carry pump out plug 650. Referring again to the load path mentioned earlier, the load path turn occurs with the shear screws in bottom sub 630 and shear sub 640. The loading through that load path enables a less expensive and shorter packer. The load path provides the load to trigger the shear release mechanism that the load path travels through in the first place.

When retrieving the packer, the retrieving string and on/off tool pull a tensile load through the stinger, the body, and shear sub 640. These parts see a tension load during the setting event. Thus, it can be understood that the retrieval shear force needs to be much higher than the setting force, or there would be a risk of shearing the retrieving mechanism during setting, which would result in a failed installation downhole.

In one example, shear sub 640 is threaded onto the body. In one example, the shoulder point to control installation length is the shear screw groove in shear sub 640 (e.g., depression 642) with the shear screw (e.g., screw 634) installed in bottom sub 630. Shear sub 640 can be designed to freely move within the inner cavity of bottom sub 630 once the shear screws are sheared. In one example, as the last step in the retrieval event, shear sub 640 shoulders on the inner diameter of bottom sub 630 and pulls that component (along with the element and lower cone) out with the rest of the packer.

In one example, shear sub 640 serves as a connection point for pump out plug 650, by screw 644 or other shear release to hold it in place. When pump out plug 650 is expelled, in one example, pressure is increased above the packer and through the packer inner diameter, which acts on O-ring 654 on pump out plug 650 and pushes it like a piston from the uphole direction. The shear screws prevent pump out plug 650 from being expelled at pressure until the desired pump out pressure is reached or exceeded.

Figure 6C:
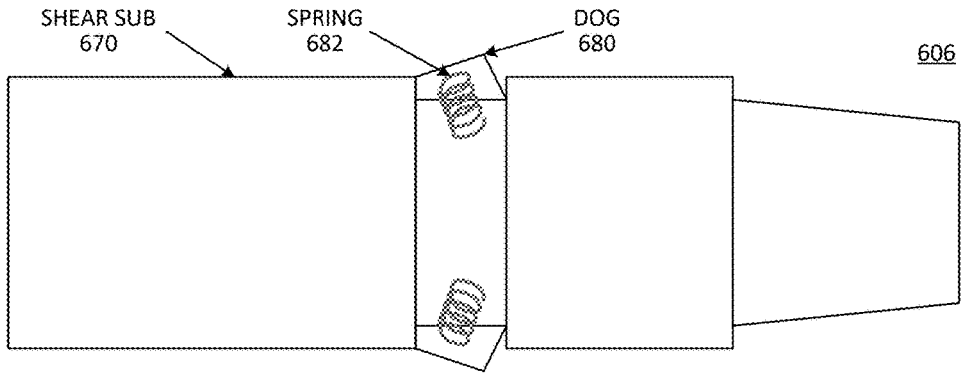
FIG. 6C is an example of a shear force assembly for a packer.

FIG. 6C is an example of a shear force assembly for a packer. Assembly 606 illustrates an alternative shear release. The structure of assembly 606 represents shear sub 670, and could also apply to the bottom sub, or other part of the packer having a shear release.

In one example, the shear release is provided through dog 680, which can internally have spring 682 to provide pressure against dog 680. Dog 680 will extend outward, away from the outer diameter, due to the pressure from spring 682. Since dog 680 is a protrusion away from the outer surface, it can engage with a depression in a corresponding structure that will apply tension against dog 680 until the shear load is exceeded. With sufficient force (e.g., the shear load threshold), spring 682 compresses, pressing dog 680 down, releasing the components from each other.

Dog 680 can be an alternative shear release to shear screws. Other alternatives can include a snap ring, a collet, or some other detent mechanism that allows axial movement once an axial threshold load is reached. In one example, a packer can be designed to apply more than one type of shear release. Different shear release mechanisms can have benefits in different applications, and mixing and matching the shear release mechanisms can provide flexibility to the designer to only allow selective axial movement of components relative to each other when a shear threshold has been reached.

Figure 7:
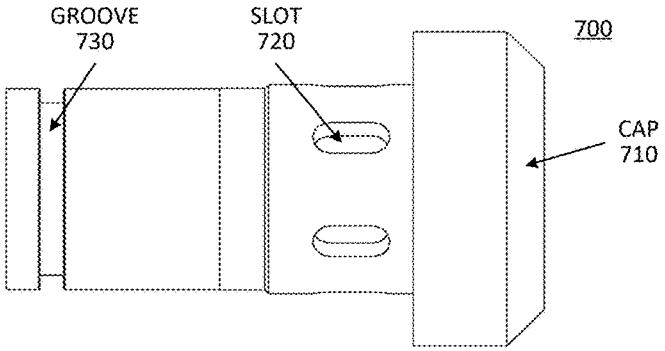
FIG. 7 is an example of a packer plug.

FIG. 7 is an example of a packer plug. Plug 700 represents a pump out plug or other plug for a downhole end of a packer. Plug 700 can serve to seal the bore on the inner diameter of the packer. The plug can seal the inner diameter while the element seals between the outer diameter of the packer against the casing inner diameter. In one example, plug 700 seals the inner diameter and completely isolates the wellbore above the packer from the wellbore below the packer.

In one example, plug 700 includes cap 710 that can shoulder against the body or the bottom sub. Slot 720 represents a slot/depression for a shear release. Slot 720 can be elongated to enable some movement before increased pressure releases the shear release. Groove 730 represents a groove to engage with an O-ring. Plug 700 can be a temporary barrier, in that it can be expelled by pressure up above the packer which will then allow the well to be produced through the packer. Plug 700 can be a persistent barrier in that it can be left in place without being expelled, which will not inhibit the packer from functioning as intended. In one example, the plug does not need to be expelled for the uphole tension to shear the shear release mechanism that enables the shear sub to move uphole to allow retrieval of the packer.

Figure 8:
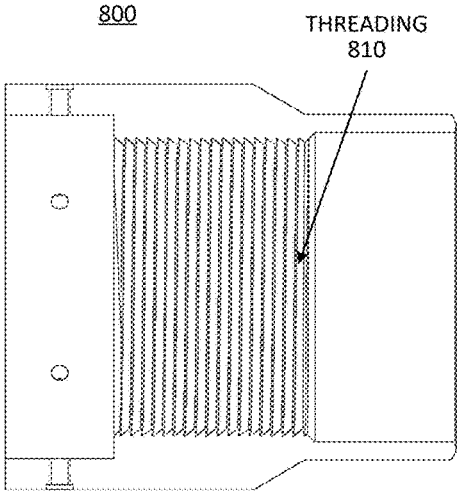
FIG. 8 is an example of a body lock support ring of a packer.

FIG. 8 is an example of a body lock support ring of a packer. Ring 800 represents a body lock support ring. Ring 800 houses the BLR, and is the component that imparts an axial load to the BLR. Ring 800 can also connect to the upper cone, and as such continues to impart setting force to the upper cone. Ring 800 includes threading 810 to ratchet with the BLR.

In one example, there are shear screws in body lock support ring that are used to prevent pre-setting, which is setting the packer before the desired depth in the wellbore. Ring 800 provides a cross-section view, which illustrates a buttress type thread that interacts with the BLR. Threading 810 is the reverse direction of that on the body, which causes it to push the BLR to the right when setting. Ring 800 can be made of large enough diameter to allow the BLR to open when ratcheting across the buttress threads on the body. The inner diameter surface of ring 800 can be threaded to connect to the upper cone.

Figure 9:
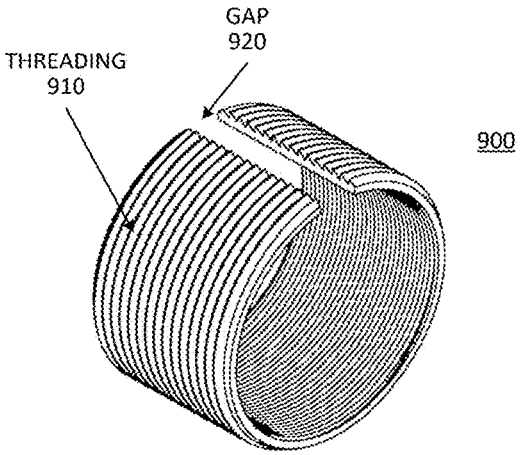
FIG. 9 is an example of a body lock ring of a packer.

FIG. 9 is an example of a body lock ring of a packer. BLR 900 can keep the packer set once the outer parts are compressed against the bottom sub and shear sub, preventing the built-up rubber pressure within the element from pushing the bottom sub away and unsetting the outer parts.

In one example, BLR is a C-ring with two types of buttress threads, one on the inner diameter and another on the outer diameter. Gap 920 represents the ring not being a complete circle, and thus, a C-ring. Threading 910 represents the buttress threads on the outer diameter. In one example, the inner diameter buttress thread is small enough to allow the BLR to expand slightly and then retract back down when travelling axially across the buttress threads on the body.

In one example, the outer diameter buttress threads (e.g., threading 910) are pushed by the mating threads in the body lock support ring, which forces BLR 900 to move relative to the body. Note that when pushing BLR 900 to the right (e.g., downhole, where left pressure is uphole, referring to the orientation of the component diagram on the page), the flat/vertical faces of the threads engage between the body lock support ring and body lock ring.

For any movement of the body lock support ring in the lefthand direction, referring to the element trying to unset the packer, the thread is pushed down the ramp of the thread tooth on the outer diameter thread, and forced to engage with the inner diameter thread, preventing any movement in that direction.

Figure 10A:
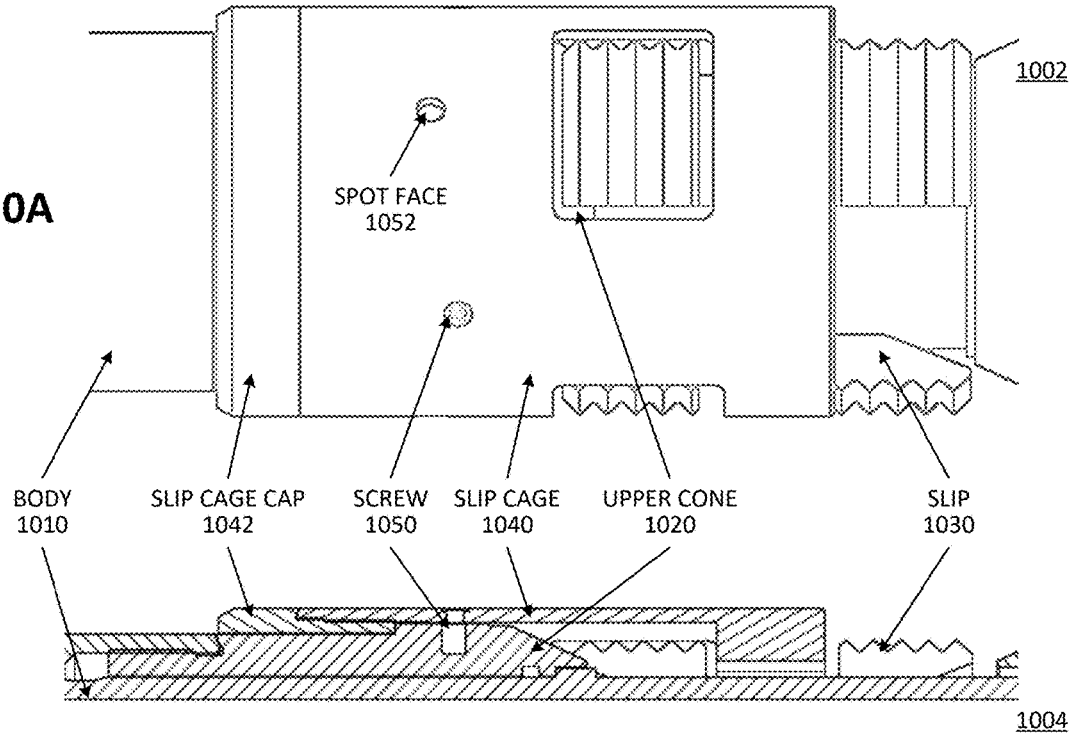
FIGS. 10A-10C are cutaway diagrams of an example of a slip assembly of a packer.
Figure 10B:
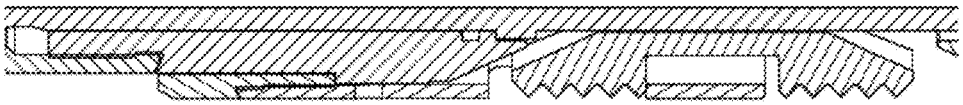
Figure 10C:
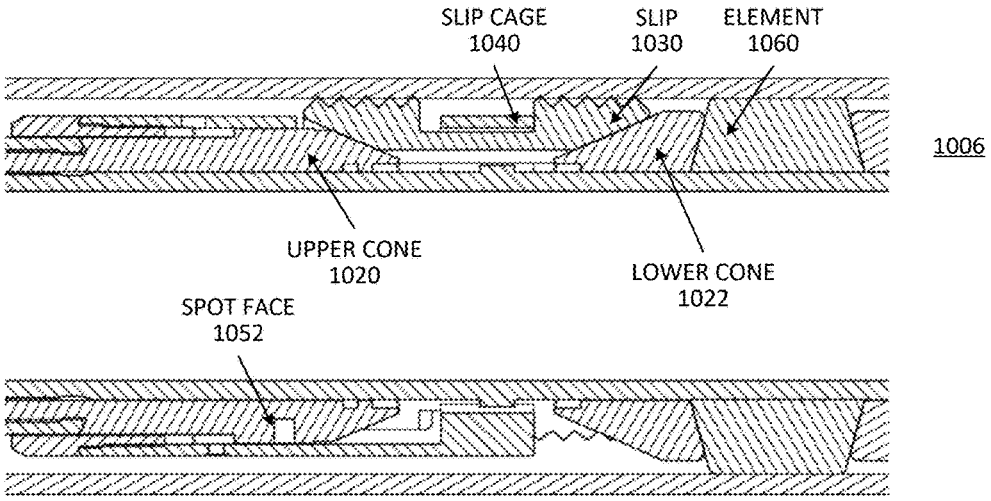

FIGS. 10A-10C are cutaway diagrams of an example of a slip assembly of a packer.

Referring to FIG. 10A, assembly 1002 illustrates a view of the outer component surfaces. Referring to FIG. 1013, assembly 1004 illustrates a cutaway view to the inner components. Body 1010 represents the packer body. The assemblies illustrate upper cone 1020, slip 1030, slip cage 1040, slip cage cap 1042, and screw 1050.

Upper cone 1020 is connected to the body lock support ring on the uphole (left) side of upper cone 1020 (right side of the body lock support ring). When the body lock support ring moves during the setting sequence, upper cone 1020 translates with it, and through linear motion it eventually comes into contact with slip 1030. The contact with slip 1030 translates with upper cone 1020 until contacting the lower cone. After contacting the lower cone, with continued linear movement of the upper cone, slip 1030 rides the conical ramp of the cones radially outward until contacting and biting/anchoring into the casing.

Internally, upper cone 1020 has an O-ring (not specifically illustrated, but which rides in the inner diameter grove second from the right), which seals on the body and keeps debris from entering the BLR region prior to setting the packer. In one example, there is a cutout on the right end of the inner diameter that can be designed to contact the retrieval ring of the body during the retrieval process. When that retrieval ring contacts upper cone 1020 with upward motion, it pulls upper cone 1020 away from the set slip.

Slip cage cap 1042 and slip cage 1040 surround upper cone 1020. In one example, slip cage 1040 is connected with a shear release (e.g., a shear screw) to upper cone 1020 as an anti-preset mechanism. Like the anti-preset shear screws of the body lock support ring and stinger combo, the shear release can keep the subassembly of slip cage 1040 and slip cage cap 1042 from moving relative to upper cone 1020. Slip cage 1040 holds slip 1030 within a linear movement range that is too small to contact either upper cone 1020 or the lower cone. Thus, slip cage 1040 cannot move relative to either upper cone 1020 or the lower cone, slip 1030 cannot make contact, and thus cannot ride up the conical surfaces of either cone and contact/anchor into the casing.

Referring to FIG. 10C, assembly 1006 illustrates details of an example bidirectional slip mechanism. In one example, slip 1030 is made up of 3 slip pads, which are bidirectional anchoring, meaning they shoulder against both upper cone 1020 and lower cone 1022 at the same time. Shouldering against both cones can hold the packer in place when subjected to pressures or loads from either the uphole or downhole direction.

When set, slip 1030 can be pushed outward along the conical faces of upper cone 1020 and lower cone 1022, via axial movement of the upper cone/body lock support ring subassembly. In one example, initially slip 1030 is pushed by the bottom face of slip cage 1040 until the shear screws between the slip cage and upper cone shear off, at which point upper cone 1020 makes contact and pushes the rest of the way. Spot face 1052 represents a depression to receive the shear screw or other shear release.

In one example, during the retrieval process, the shoulder between upper cone 1020 and slip cage cap 1042 is what transmits retrieval pulling force into slip cage 1040, and further into slip 1030, which pulls the slip away from lower cone 1022 and down from the casing. At this point upper cone 1020 will have been pulled away by the body retrieval ring interface.

While not specifically illustrated in assembly 1006, in one example, there are multiple (e.g., two or three) leaf springs between each slip pad and the inner diameter of slip cage 1040 around slip 1030. The springs can force each slip pad to be pushed radially inward and against the body, keeping them clear of contacting the casing prematurely during run-in (e.g., the set procedure).

It will be understood that the bidirectional slip described can anchor the packer to the casing, allowing for a shorter packer length. Another way to anchor into the casing is to use a slip and cone system above and below element 1060, which anchors against forces in both the uphole and downhole directions. Replacing the two-slip system to the bidirectional slip, which has cones are on both sides of the slip, reduces the length of the packer, as well as making unsetting and retrieving the packer less complicated.

Figure 11A:
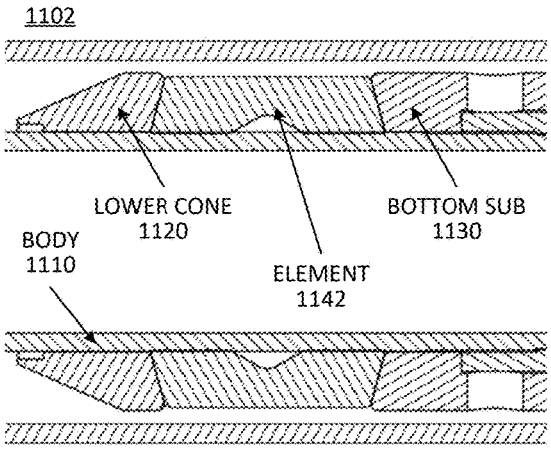
FIGS. 11A-11B are cutaway diagrams of an example of packer element compression.
Figure 11B:
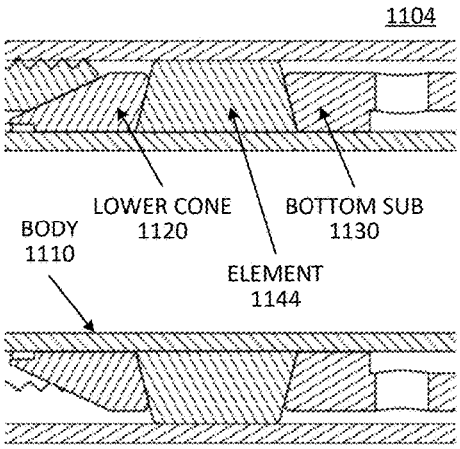

FIGS. 11A-11B are cutaway diagrams of an example of packer element compression.

Referring to FIG. 11A, assembly 1102 illustrates the packer element uncompressed. Element 1142 is positioned on the outside of body 1110, between lower cone 1120 and bottom sub 1130. Element 1142 represents the element in the natural state of being decompressed or uncompressed. In one example, the primary role of lower cone 1120 is to serve as a conical ramp for the slip to ride radially outward during the setting process. Another role of lower cone 1120 is to shoulder internally on the retrieval ring of body 1110 for a positive shoulder during assembly. The retrieval ring is not specifically illustrated in assembly 1102.

Referring to FIG. 11B, assembly 1104 illustrates the packer element compressed. Lower cone 1120 can shoulder against the element to compress it. Element 1144 represents the element in the compressed state. During the setting process, as the slip is pushed into lower cone 1120, lower cone 1120 pushes into the element, compressing it into element 1144. Because the element shoulders against the fixed bottom sub 1130 that does not move, the force causes element 1144 to compress linearly, forcing its volume outward until contacting and sealing against the casing. It can be observed that element 1144 is taller and narrower than element 1142. Note how element 1144 extends past the top of lower cone 1120, whereas element 1142 is lower than the top of lower cone 1120.

Figure 12:
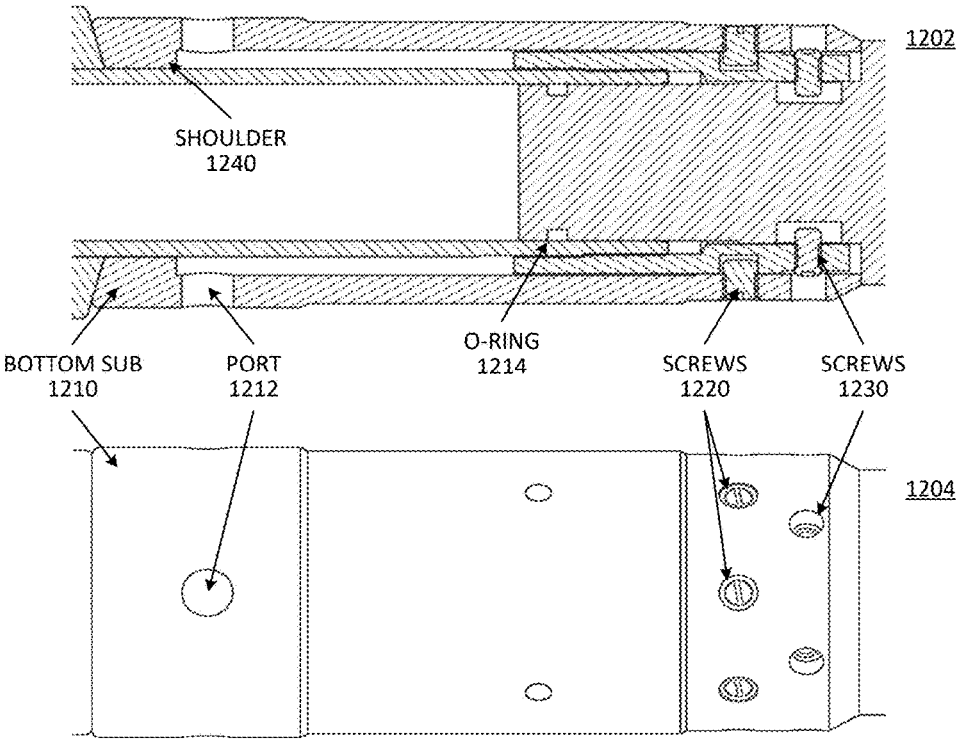
FIG. 12 illustrates an example of a bottom sub of a packer.

FIG. 12 illustrates an example of a bottom sub of a packer. Assembly 1202 illustrates a cutaway view of the bottom sub, while assembly 1204 illustrates an outer diameter/outer surface of the bottom sub. The assemblies illustrate bottom sub 1210, port 1212, O-ring 1214, screws 1220, and screws 1230.

Bottom sub 1210 serves to connect the outer components with the inner components through the interface shared between the shear sub, shear screws or other shear release, and bottom sub 1210. When it is fixed to the body through the shear sub, bottom sub 1210 provides a fixed shoulder against the element and allows the element to compress during setting.

In one example, the inner diameter of bottom sub 1210 is configured to allow the shear sub to translate uphole until shouldered against the inner diameter shoulder (shoulder 1240), which provides the needed length of stinger/body/shear sub movement for the retrieval process.

Port 1212 is represented by the large holes on the left side of bottom sub 1210, which allow for fluid evacuation when the shear sub is moving within bottom sub 1210. The evacuation of liquid can be necessary where the movement of the shear sub results in a volume change. The small holes in the middle of bottom sub 1210 represent installation holes that allow assembly of set screws in the shear sub when installed.

The holes on the right are illustrated as having screws installed. Screws 1220 represent retrieval shear screws, the same shear screws that transfer load from the outer components to the inner components during setting. Screws 1220 can hold the packer components in place until the retrieval force has been applied and the screws are sheared. Again, another shear release can be used in place of screws 1220.

The holes on the far right are also illustrated as having screws installed. The holes represent installation holes for shear screws that are installed into the shear sub to hold the pump out plug in place. Those installation screws are represented by screws 1230. In one example, the righthand face of bottom sub 1210 serves as a shoulder for the pump out plug when pressure from below the packer (pressure from downhole) is applied and forces the pump out plug in the uphole direction.

Figure 13:
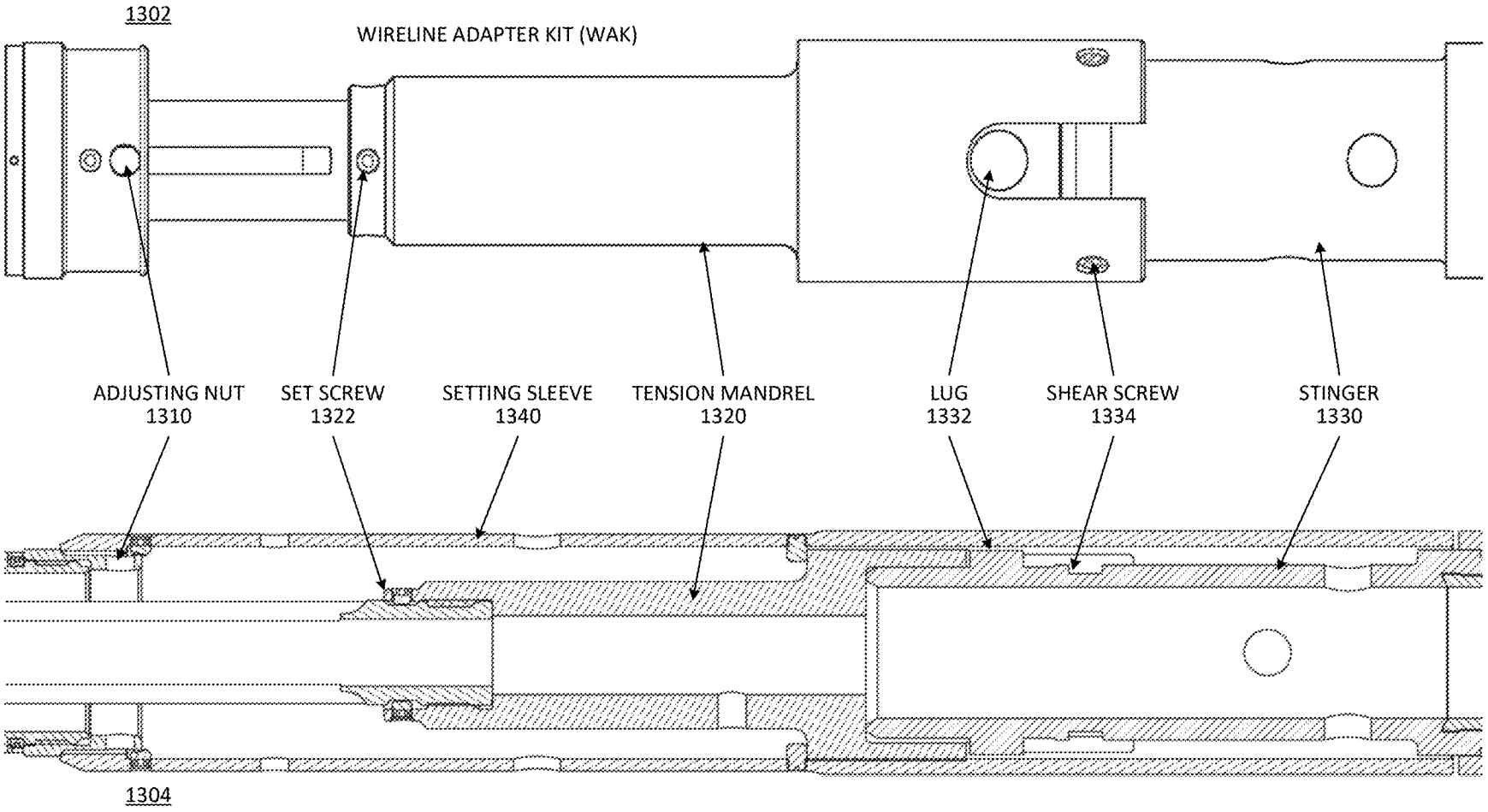
FIG. 13 illustrates an example of a wireline adapter kit for a packer.

FIG. 13 illustrates an example of a wireline adapter kit for a packer. Assembly 1302 illustrates a wireline adapter kit (WAK). Assembly 1304 illustrates a cutaway view of the WAK. The assemblies illustrate adjusting nut 1310, tension mandrel 1320, set screw 1322, stinger 1330, lug 1332, shear screw 1334, and setting sleeve 1340.

The installation can be configured with many different tools depending on the operation, but the bottom most tools for a packer installation include a setting tool, which can either be wireline or hydraulic. Wireline refers to an electrical impulse that activates a power charge that builds pressure inside the setting tool, and produces force and axial movement of the setting tool. Hydraulic refers to a tool conveyed on tubing and the tubing inner diameter is pressurized to active and stroke the setting tool, resulting in axial movement and axial force.

A wireline adapter kit (WAK) refers to a set of components that connect the industry standard setting tools to different and unique tools, such as the described packer. The WAK allows the axial force and translation of the setting tool to be imparted into the tool that is being set. The setting tool can include two downhole connections for attaching to the WAK. The "inner" downhole connection is fixed in place with the rest of the installation string and during setting can be assumed to be stationary. Tension mandrel 1320 is connected to the inner downhole connection.

The "outer" downhole connection moves downhole when the setting tool is activated and exerts a force in the downhole direction. Setting sleeve 1340 is connected to the outer downhole connection. Setting sleeve 1340 represents a component that will move with the setting tool and impart axial force and displacement into the outer components of the packer during setting. In one example, setting sleeve 1340 has a set of anti-preset shear screws that shoulder on tension mandrel 1320 during run-in. The screws prevent setting sleeve 1340 from making contact with the body lock support ring until the setting event is initiated.

Tension mandrel 1320 anchors the inner components of the mandrel to the fixed components of the setting tool, providing a fixed subassembly for the outer components to set against. In one example, tension mandrel 1320 is held to stinger 1330 with a set of shear screws, represented by shear screw 1334. These screws will shear off, releasing the WAK and installation assembly from the set packer, when the threshold setting force is achieved.

Adjusting nut 1310 can be used to configure setting sleeve 1340 to the setting tool. Adjusting nut 1310 can primarily be used to adjust for any gaps formed by tolerance gaps through the assembly. Lug 1332 represents the structure in the body of stinger 1330 that can receive the force provided through tension mandrel 1320, providing the load path to the downhole components.

Figure 14:
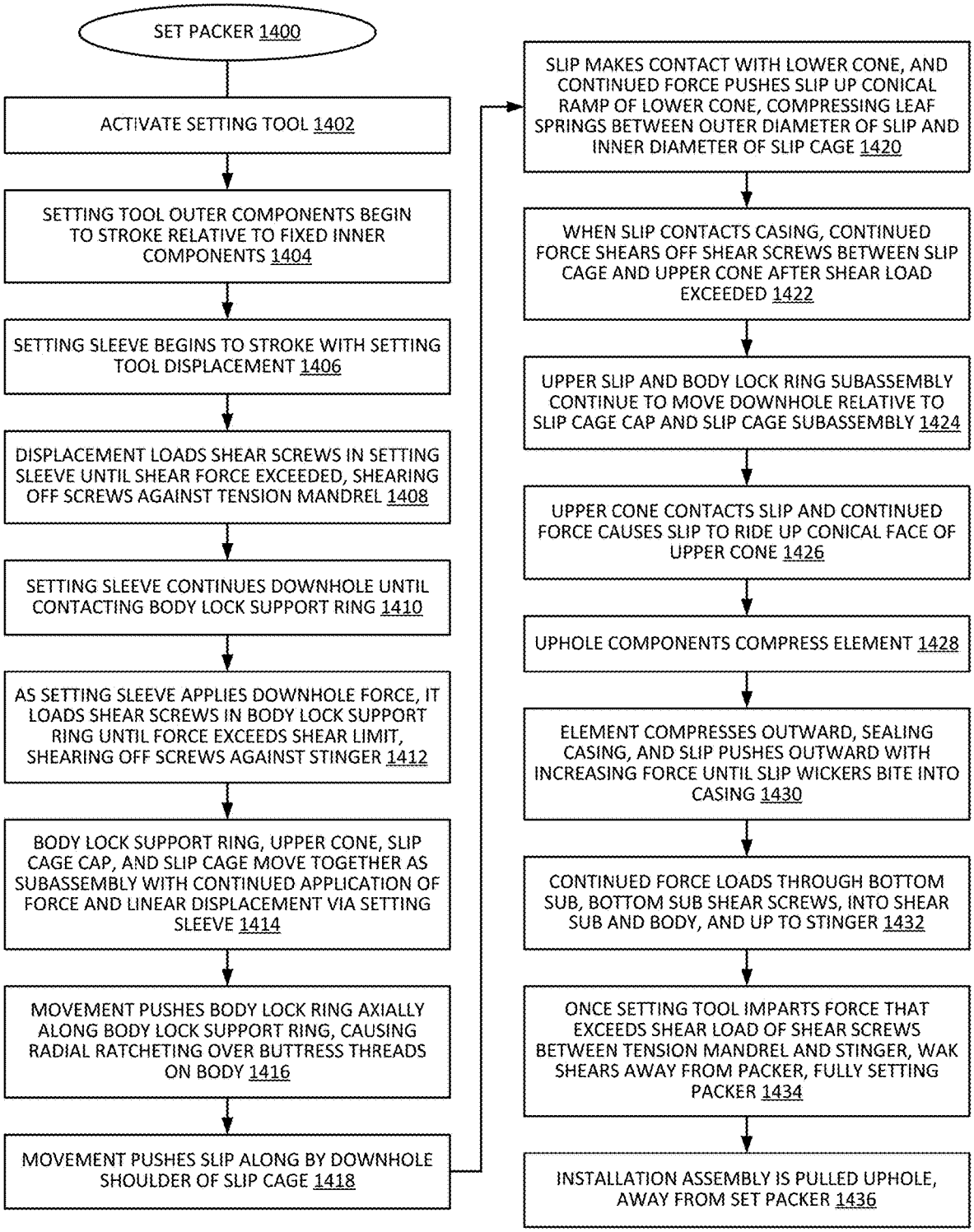
FIG. 14 is a flow diagram of an example of setting a packer.

FIG. 14 is a flow diagram of an example of setting a packer. Process 1400 illustrates a process for setting a packer in accordance with any example herein.

The surface equipment activates the setting tool, at 1402. The activation can be either electronic or hydraulic. The setting tool outer components begin to stroke relative to fixed inner components, at 1404. In one example, the setting sleeve begins to stroke with the setting tool displacement, at 1406.

In one example, the displacement loads the shear screw in the setting sleeve until the shear force is exceeded, shearing off the screws against the tension mandrel, at 1408. The setting sleeve continues to move downhole until contacting the body lock support ring, at 1410. In one example, as the setting sleeve applies downhole force, it loads the shear screws in the body lock support ring until the force exceeds the shear limit, shearing off the screws against the stinger, at 1412.

In one example, the body lock support ring, the upper cone, the slip cage cap, and the slip cage move together as a subassembly with continued application of force and linear displacement via the setting sleeve, at 1414. In one example, the movement pushes the body lock ring axially along by the body lock support ring, causing radial ratcheting over the buttress threads on the body, at 1416. The movement pushes the slip along by the downhole shoulder of the slip cage, at 1418.

In one example, the slip makes contact with the lower cone, and continued application of force pushes the slip up the conical ramp of the lower cone, compressing the leaf springs between the outer diameter of the slip and inner diameter of the slip cage, at 1420. When the slip contacts the casing, continued application of force shears off the shear screws between the slip cage and the upper cone after the shear load is exceeded, at 1422.

The upper slip and body lock ring subassembly continue to translate downhole relative to the slip cage cap and slip cage subassembly, at 1424. The upper cone contacts the slip and causes the slip to ride up the conical face of the upper cone by continued application of linear force, at 1426. The uphole components (the upper cone subassembly, the slip, and the lower cone) all translate downhole, compressing the element, at 1428.

As the element compresses outward, it seals on the casing, and the slip pushes outward with increasing force until the slip wickers (teeth) bite into the casing, at 1430. The continued application of force loads through the bottom sub, the bottom sub shear screws, into the shear sub and the body, and up to the stinger, at 1432.

Once the setting tool imparts a force that exceeds the shear load of the shear screws between the tension mandrel and the stinger, the WAK shears away from the packer, fully setting the packer, at 1434. At this point, the installation assembly is pulled uphole, away from the set packer, and operations will generally commence once that equipment is removed from the well, at 1436.

Figure 15:
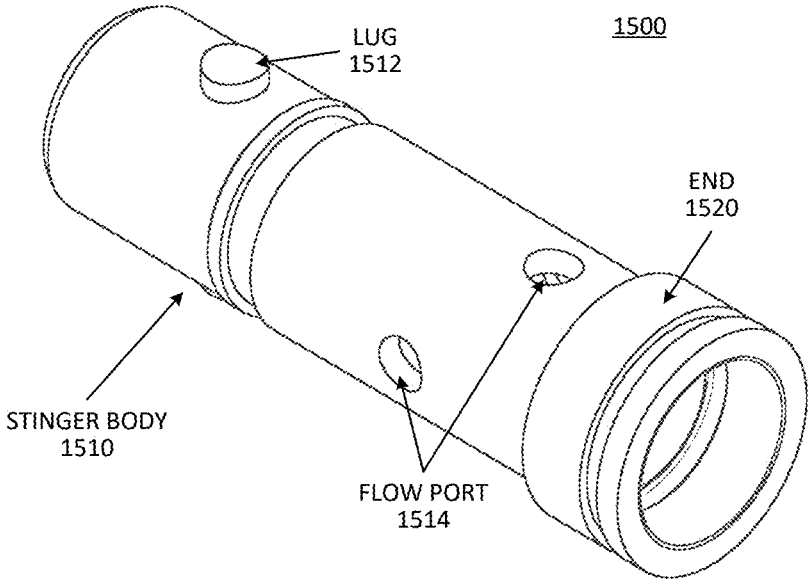
FIG. 15 is an example of a packer stinger.

FIG. 15 is an example of a packer stinger. Stinger 1500 represents a stinger for a packer in accordance with any description herein. Stinger 1500 serves as the upper-most portion of the packer, to engage with the setting components and with the retrieval components.

During installation into the wellbore (e.g., conveyance to setting depth via pipe, wireline, or coil tubing), in one example, stinger 1500 hangs from the bottom of the installations string by a set of shear screws that ride in a groove set in the outer diameter of stinger 1500. The groove in stinger body 1510 can provide for the shear screws. The shear screws can be installed in the tension mandrel of the WAK, and once a setting force is imparted on the packer, the setting force increases to the shear screw failure point. After the shear release, stinger 1500 then releases from the WAK and the rest of the installation string.

In one example, stinger 1500 has two "retrieval lugs" on the outer diameter, represented by lug 1512. Lug 1512 represents features that come into play after the packer has been set in the well, performed its function, and is then ready to be removed from the wellbore. The smaller outer diameter of stinger 1500 (relative to the rest of the packer) enables an on/off tool to swallow over stinger 1500.

In one example, stinger 1500 includes flow ports 1514 on (or through) stinger body 1510. In the event of retrieval of the packer, once the on/off tool is latched onto the packer, fluid can be circulated down the wellbore and into the retrieval string through flow ports 1514. The ports allow the washing out (cleaning off) the area above the packer in case there is sediment or debris, to make retrieval that much easier.

In one example, there is an additional shear screw groove on the bottom of stinger 1500, which interacts with shear screws that are installed in the body lock support ring. Such shear screws can provide an anti-preset safety feature. The anti-preset safety feature works because an axial load greater than that total shear value of the screws must be imparted on the body lock support ring to cause it to travel beyond its assembled position. The required load prevents sudden stops or jarring motions from moving the outer components and potentially setting the packer prematurely. End 1520 represents the downhole end of stinger 1500 that engages with the body of the packer.

Figure 16:
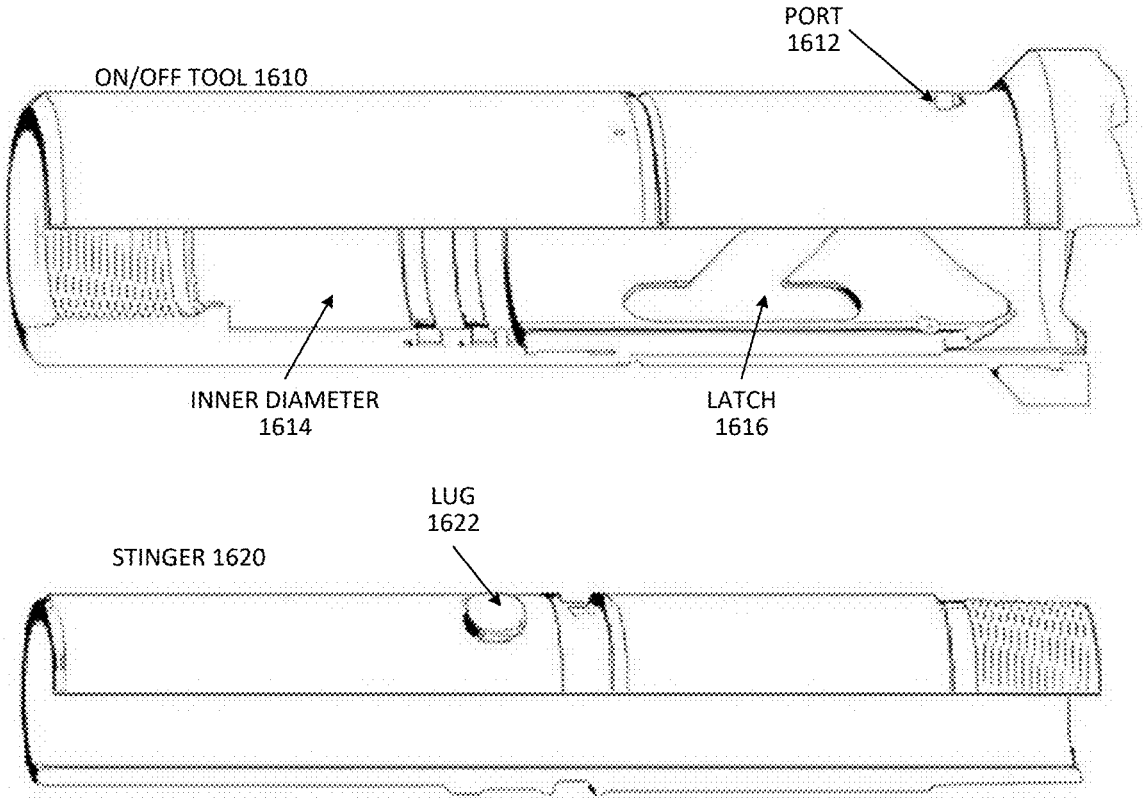
FIG. 16 is an example of an on-off tool for a packer.

FIG. 16 is an example of an on-off tool for a packer. Stinger 1620 illustrates a stinger in accordance with an example of stinger 1500. On/off tool 1610 (hereafter, simple "tool 1610) engages with stinger 1620 for retrieval.

As illustrated, tool 1610 has helical J-slots on its inner diameter, which can latch onto lugs 1622 on the outer diameter of stinger 1620. Tool 1610 includes latch 1616 on inner diameter 1614, which can represent the J-slots. Port 1612 represents a port to allow the flow of fluid during the retrieval process. Inner diameter 1614 represents the inside surface of tool 1610.

With action on the J-slot, tool 1610 captures lugs 1622, and with a small amount of rotation, locks the lugs within the on/off tool. After locking lugs 1622, tool 1610 can be rotated off the packer as needed, or once locked onto the stinger lugs, the retrieval string and tool 1610 can be pulled in tension to release the packer from the set position. After being released, continued tension from tool 1610 can remove the packer from the well.

Figure 17A:
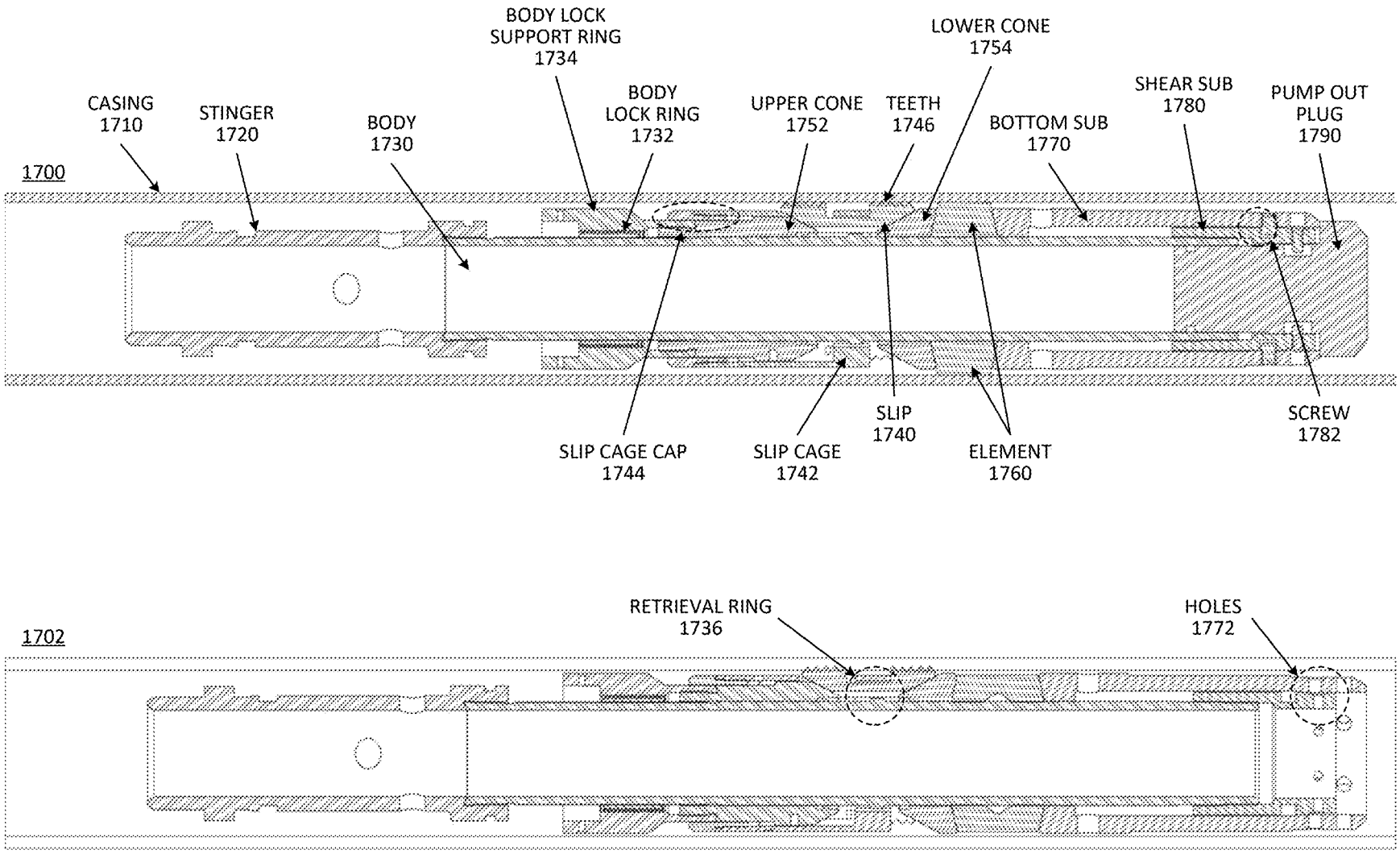
FIGS. 17A-17B illustrate an example of states of a packer being retrieved.
Figure 17B:
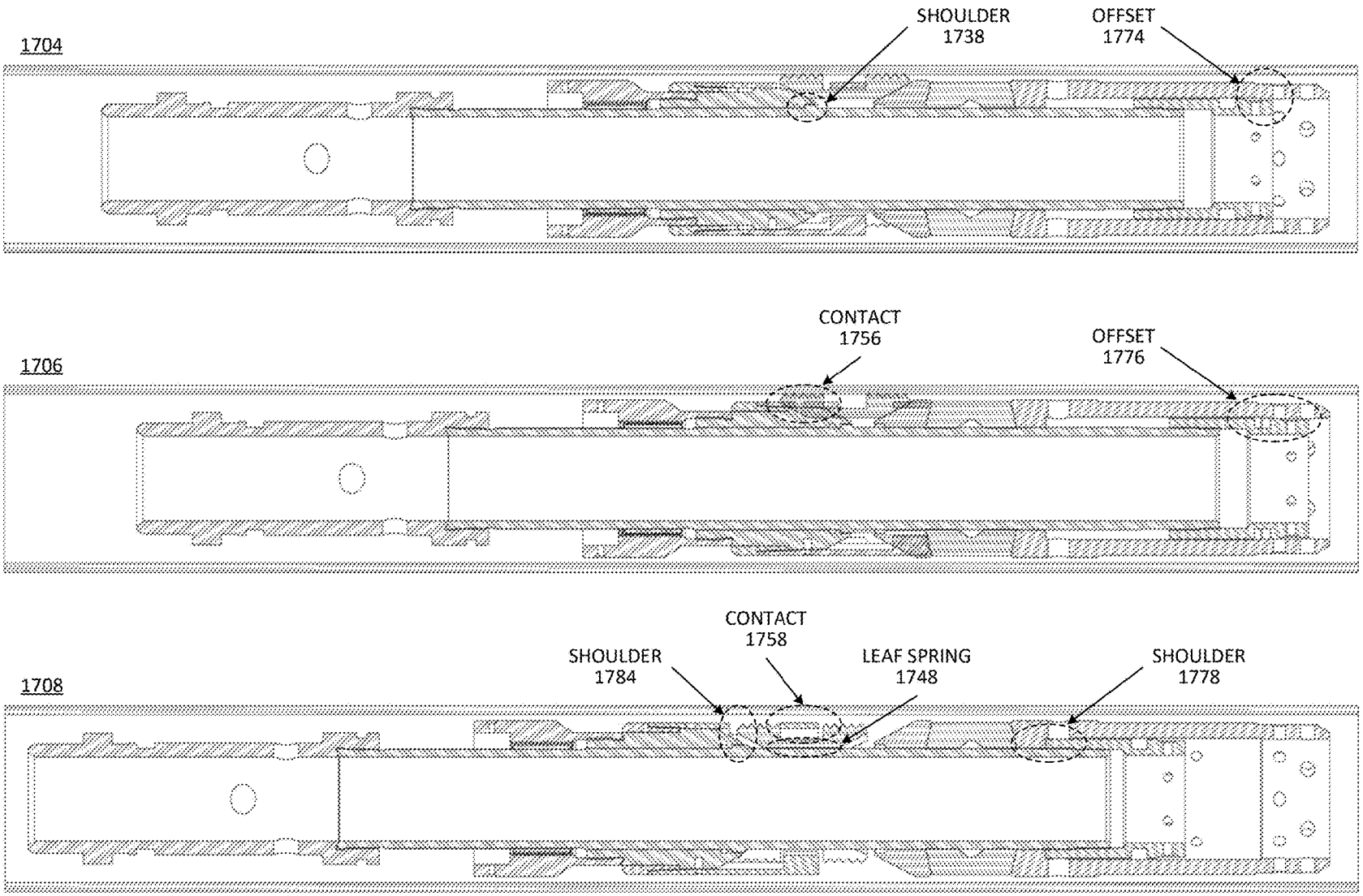

FIGS. 17A-17B illustrate an example of states of a packer being retrieved. State 1700 represents a set state for a packer in accordance with any description herein.

Referring to FIG. 17A, State 1700 illustrates casing 1710, which represents the wellbore in which the packer is installed. Stinger 1720 represents a stinger in accordance with any example described. Body 1730 represents the body of the packer, to which the other components are installed.

Body 1730 includes body lock ring (BLR) 1732, which engages with body lock support ring 1734, which is installed around BLR 1732. Slip 1740 is installed around body 1730. Slip 1740 is surrounded by slip cage 1742 and slip cage cap 1744. Slip 1740 sits between upper cone 1752 and lower cone 1754. Slip 1740 can ride up the sloped surfaces of the cones, causing teeth 1746 to secure into/against casing 1710.

Element 1760 is situated between lower cone 1754 and bottom sub 1770. Element 1760 can be compressed and decompressed based on uphole and downhole movement of the components of the packer. Bottom sub 1770 surrounds shear sub 1780, and secures to the shear sub through a shear release, such as screw 1782. Pump out plug 1790 engages with bottom sub 1770 and shear sub 1780 in accordance with what is described elsewhere.

State 1702 illustrates the first part of the retrieval process. While not part of the retrieval process, and not necessary for retrieval, state 1702 illustrates the packer when pump out plug 1790 has been expelled.

Tension pulling the assembly uphole will increase pressure on screw 1782 until the shear load is exceeded and the screw shears off. Then stinger 1720, body 1730, and shear sub 1780 move uphole from the tension. Body 1730 moves uphole relative to BLR 1732, and BLR 1732 ratchets within body lock support ring 1734. Retrieval ring 1736 moves uphole relative to lower cone 1754, due to the uphole movement of the body. It can be observed that holes 1772 are now approximately horizontally aligned, where they started with some horizontal separation. Element 1760 relaxes when the bottom sub shear screws are released, pushing the lower cone and the bottom sub apart, which releases the pressure of the element on casing 1710.

Referring to FIG. 17B, state 1704 illustrates the next part of the retrieval process for the packer. Stinger 1720, body 1730, and shear sub 1780 continue to move uphole. Retrieval ring 1736 makes contact with upper cone 1752, illustrated by shoulder 1738. It can be observed that holes 1772 are not horizontally aligned any more, where offset 1774 illustrates how the horizontal separation has now reversed as shear sub 1780 continues to move uphole relative to bottom sub 1770.

State 1706 illustrates the next part of the retrieval process for the packer. Stinger 1720, body 1730, and shear sub 1780 continue to move uphole. Offset 1776 illustrates how the horizontal separation increases as shear sub 1780 continues to move uphole relative to bottom sub 1770. Retrieval ring 1736 is in contact with upper cone 1752, pulling upper cone 1752 into contact 1756 with slip cage cap 1744. Body 1730 continues to move, and BLR 1732 continues to ratchet with body lock support ring 1734.

State 1708 illustrates the next part of the retrieval process for the packer. Stinger 1720, body 1730, and shear sub 1780 continue to move uphole until shear sub 1780 engages with bottom sub, with shoulder 1778. Now the entire bottom sub moves as a subassembly with the body. Leaf spring 1748 illustrates a leaf spring pushing slip 1740 radially outward. Slip cage 1742 is moved uphole with slip cage cap 1744, which is pushed by upper cone 1752, until slip cage 1742 engages with slip 1740 with contact 1758. Slip 1740 is pulled uphole by slip cage 1742, and shoulder 1784 continues to pull the whole assembly out. The packer moves uphole as a unit until reaching the upper equipment.

Figure 18:
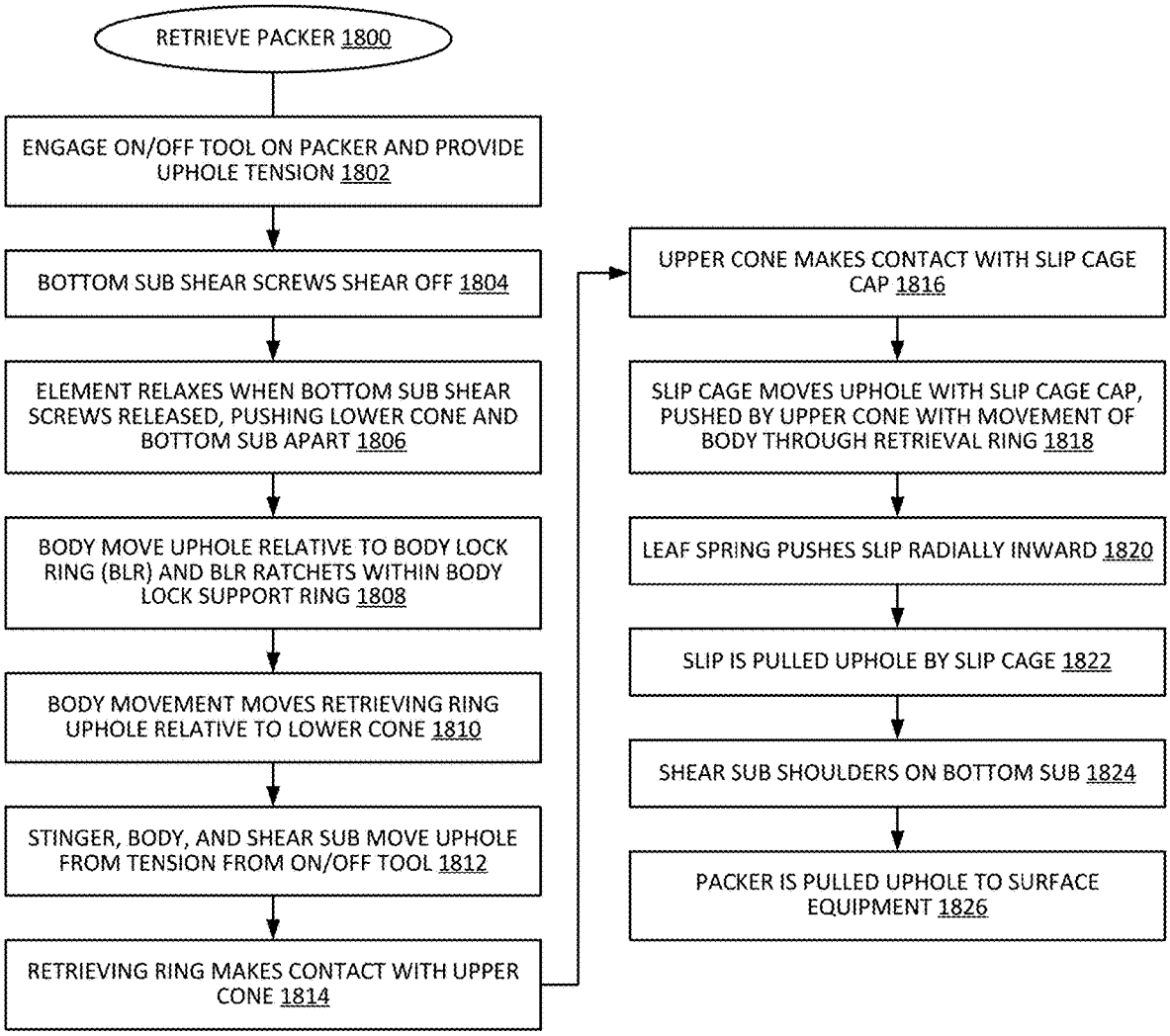
FIG. 18 is a flow diagram of an example of retrieving a packer.

FIG. 18 is a flow diagram of an example of retrieving a packer. Process 1800 illustrates a process for retrieval of a packer in accordance with any example herein.

The operators can engage the on/off tool on the packer and provide uphole tension on the assembly, at 1802. In response to the uphole tension, the bottom sub shear screws shear off, at 1804. Alternatively, the tension can trigger another shear release.

The element relaxes when the shear release occurs, pushing the lower cone and the bottom sub apart, at 1806. The body moves uphole relative to the BLR, and the BLR ratchets within the body lock support rings, at 1808. The body movement moves the retrieving ring uphole relative to the lower cone, at 1810.

The stinger, body, and shear sub move uphole from tension from the on/off tool, at 1812. The retrieving ring contacts the upper cone, at 1814. The upper cone in turn contacts the slip cage cap, at 1816. The slip cage moves uphole with the slip cage cap, pushed by the upper cone with movement of the body through the retrieval ring, at 1818.

In one example, a leaf spring pushes the slip radially inward, at 1820. The slip is pulled uphole the slip cage, at 1822. The shear sub shoulders on the bottom sub, at 1824, and the packer is pulled uphole to the surface equipment, at 1826.

Figure 19:
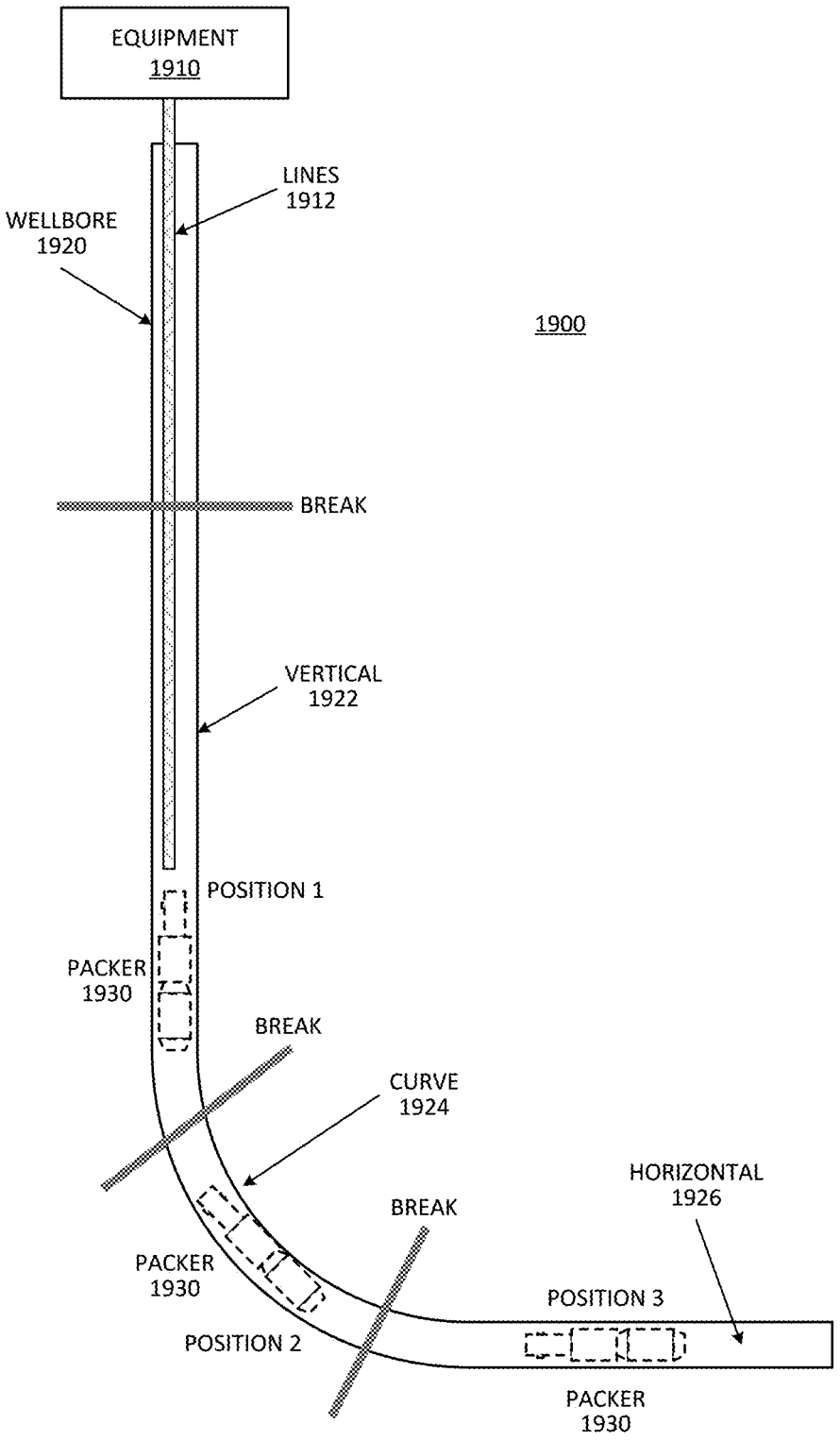
FIG. 19 is an example of wellbore with a packer.

FIG. 19 is an example of wellbore with a packer. System 1900 illustrates wellbore 1920, which represents a wellbore in accordance with any example herein. Wellbore 1920 can have a vertical portion (vertical 1922), a horizontal portion (horizontal 1926), and a curved portion (curve 1924) that interfaces vertical 1922 with horizontal 1926.

The breaks represent the fact that the diagram is not necessarily to scale. The vertical portion of the wellbore can be many thousand feet (thousands of meters). Equipment 1910 represents the surface equipment that controls the operation of the components put into wellbore 1920. Lines 1912 represent the lines (e.g., electrical and/or hydraulic) that extend from equipment 1910 to packer 1930 in wellbore 1920.

As illustrated, packer 1930 can be set anywhere in wellbore 1920. Position 1 illustrates packer 1930 set in the vertical portion. Position 2 illustrates packer 1930 set in the curved portion. Position 3 illustrates packer 1930 set in the horizontal portion. The setting and retrieving described herein will work in any portion of wellbore 1920.

Typically, for tension retrievable packers, the retrieval event is initiated with a given amount of tensile force (say, force X), and force X is always the amount of retrieval force used. The packer described has an adjustable amount of retrieval force needed to initiate the retrieval event. Such a capability enables different applications. By the time a user goes to retrieve a packer, there is typically not a large rig that can pull an extremely high amount of tension when picking up. Rather, they will use a smaller workover rig or the like that is on location. The maximum pull capabilities of the smaller workover units is known, but the depth that the packer is set at is not known, and the depth amounts to pipe weight. More pipe hanging from the workover unit reduces the total amount of force that can be applied to the packer. Thus, setting the packer for different tensile strength can enable use of different equipment than has been able to be used previously.

The packer described can be applied as a downhole apparatus to be installed in place within a wellbore to provide hydraulic and/or mechanical isolation. The downhole apparatus is able to be uninstalled from the wellbore any time after being installed. In one example, the downhole apparatus has a fully adjustable and settable retrieving force.

The packer can be applied as a downhole apparatus having a variable force retrieving mechanism, where a force adjustable release mechanism allows for altering the required applied force to retrieve the downhole apparatus from the set position to a release position. The force adjustable release mechanism, which can be referred to as a shear release, can be or include a shear screw, a set of shear screws, a snap ring, a collet, spring-loaded dogs, or other detent mechanism that allows axial movement once an axial threshold load is reached.

The packer can be utilized in a method for a bidirectional slip apparatus/anchor (e.g., packer, plug, or other mechanism), to act as a barrier to prevent an object that can fall in a wellbore from falling deeper in the wellbore. The packer can be a bidirectional slip apparatus to act as a landing point for an electrical submersible pump (ESP) when it fails and falls downhole. The bidirectional slip anchor can act as a stop or catch for the ESP, and then the retrieval of the ESP by use of the bidirectional slip anchor.

The descriptions include a method of utilizing a bidirectional slip anchor with a plugged body to prevent hydraulic communication above and below the anchor, to act as a stop for an object that can fall in a wellbore, and then be retrieved from said wellbore. The plug can prevent hydraulic communication above and below the anchor, where the plug can be expelled to establish hydraulic communication above and below the anchor.

The descriptions include a method of utilizing a bidirectional slip anchor to act as a stop for an object that can fall in a wellbore, and then be retrieved from the wellbore, where a load required to retrieve the apparatus is adjustable.

The descriptions include a method of setting and retrieving a bidirectional slip anchor between vertical (0°) and horizontal (90°) orientations of a wellbore. The setting and retrieving of the bidirectional slip anchor can be a single slip anchor, a tangential slip anchor, a barrel slip anchor, a dual slip anchor, or a hydraulic hold down slip anchor.

The descriptions include a method of setting and retrieving a bidirectional slip anchor in the curve of a horizontal wellbore. The setting and retrieving of the bidirectional slip anchor can be a single slip anchor, a tangential slip anchor, a barrel slip anchor, a dual slip anchor, or a hydraulic hold down slip anchor.

The descriptions include a method of setting and retrieving a bidirectional slip anchor in the horizontal of a horizontal wellbore. The setting and retrieving of the bidirectional slip anchor can be a single slip anchor, a tangential slip anchor, a barrel slip anchor, a dual slip anchor, or a hydraulic hold down slip anchor.

In a first example, a wellbore packer includes: a bottom sub on a downhole portion of the wellbore packer, the bottom sub having a cylindrical cross section and an inner cavity, the bottom sub having a threaded hole through a wall of the bottom sub; a shear sub within the inner cavity of the bottom sub, the shear sub having a depression in a wall of the shear sub, the depression to align in a set position of the wellbore packer with the threaded hole; and a body to extend from an uphole portion of the wellbore packer to the shear sub, the body secured to the shear sub; wherein the threaded hole is to receive a shear screw of variable shear strength, a head of the shear screw to be positioned within the depression in the set position of the wellbore packer, and wherein, in response to increased uphole tensile force on the body, the shear sub is to shear the shear screw and move uphole relative to the bottom sub, and unset the wellbore packer from the set position.

In a second example, in accordance with the first example, the shear screw can be selected with different shear strength for different applications having different tensile force capabilities.

In a third example, in accordance with the first example, the threaded hole comprises multiple threaded holes, and wherein the threaded hole to receive a shear screw of variable shear strength comprises the multiple threaded holes to receive a variable number of shear screws to vary the shear strength.

In a fourth example, in accordance with the first example, the set position comprises a set position between a vertical and a horizontal orientation of a wellbore. In a fifth example, in accordance with the fourth example, the set position comprises a set position in a curve of a horizontal wellbore.

In a sixth example, in accordance with the first example, the wellbore packer includes a pump out plug to connect to a downhole portion of the shear sub in the set position. In a seventh example, in accordance with the sixth example, the depression comprises a first depression and the shear screw comprises a first shear screw; wherein the pump out plug is to connect to the downhole portion of the shear sub with a second shear screw; wherein the shear sub has a threaded hole through a wall of the shear sub to receive the second shear screw, and wherein the pump out plug has a second depression in a wall of the pump out plug, with a head of the second shear screw to be positioned in the second depression in the set position. In an eighth example, in accordance with the seventh example, hydraulic pressure from uphole is to shear the second shear screw to remove the pump out plug from the wellbore packer. In a ninth example, in accordance with the sixth example, the pump out plug is to prevent hydraulic communication above and below the wellbore packer in the set position, and wherein removal of the pump out plug is to establish hydraulic communication through the wellbore packer.

In a tenth example, in accordance with the first example, the depression comprises a groove. In an eleventh example, in accordance with the first example, the depression comprises a slot or a spot face.

In a twelfth example, in accordance with the first example, the wellbore packer includes: a compressive element to compress in the set position and decompress after the shear screw is sheared.

In a thirteenth example, in accordance with the first example, the wellbore packer includes: a body lock ring (BLR), the BLR to ratchet against the body as the body moves uphole.

In a fourteenth example, in accordance with the first example, in response to the increased uphole tensile force on the body, the shear sub is to shoulder on the bottom sub to pull the wellbore packer uphole. In a fifteenth example, in accordance with the fourteenth example, in response to the increased uphole tensile force on the body, a body retrieval ring on an outside surface of the body is to shoulder on an upper cone of the wellbore packer, the upper cone is then to shoulder on a slip cage of the wellbore packer, and the shear sub is to shoulder to the bottom sub. In a sixteenth example, in accordance with the fourteenth example, in response to the increased uphole tensile force on the body, a slip cage shoulders on a slip, and the slip moves radially inward and uphole relative to a casing within which the wellbore packer is positioned.

The teachings of the present disclosure may be used in a variety of well operations.

While preferred materials for elements of the invention (e.g., components) have been described, the apparatuses of the present invention are not limited by these materials. Wood, plastics, fiber reinforced phenolics, fiber reinforced resins, elastomers, foam, metal alloys, sintered metals, ceramics, fiber, or fabric reinforce composites, and other materials may comprise some or all elements of the apparatuses in various implementations.

Besides what is described herein, various modifications can be made to what is disclosed and implementations of the invention without departing from their scope. Therefore, the illustrations and examples herein should be construed in an illustrative, and not a restrictive sense. The scope of the invention should be measured solely by reference to the claims that follow.

What is claimed is:

1. A wellbore packer, comprising:

a bottom sub on a downhole portion of the wellbore packer, the bottom sub having a cylindrical cross section and an inner cavity, the bottom sub having a shear release in a wall of the bottom sub;

a shear sub within the inner cavity of the bottom sub, the shear sub having a depression in a wall of the shear sub, the depression to align in a set position of the wellbore packer with the shear release, wherein a protrusion of the shear release is positioned within the depression in the set position to restrict movement of the shear sub relative to the bottom sub in the set position of the wellbore packer; and a body to extend from an uphole portion of the wellbore packer to the shear sub, the body secured to the shear sub to set the wellbore packer, wherein the shear release is in a path of force applied to set the wellbore packer;

wherein the shear release is configurable to variable shear strength, requiring a selectable amount of shear force to be applied to allow movement of the shear sub to unset the packer from the set position, and wherein, in response to increased uphole tensile force on the body exceeding the selectable amount of shear force, the shear release is to release, to allow movement of the shear sub uphole relative to the bottom sub, and unset the wellbore packer from the set position, wherein the uphole tensile force is greater than the force that sets the wellbore packer and wherein, in response to the increased uphole tensile force on the body, the shear sub is to shoulder on the bottom sub to pull the wellbore packer uphole.

2. The wellbore packer of claim 1, wherein the set position comprises a set position between a vertical and a horizontal orientation of a wellbore.

3. The wellbore packer of claim 2, wherein the set position comprises a set position in a curve of a horizontal wellbore.

4. The wellbore packer of claim 1, wherein the shear release comprises a shear screw, wherein the bottom sub has a threaded hole through a wall of the bottom sub, wherein the threaded hole is to receive a shear screw of variable shear strength, a head of the shear screw to be positioned within the depression in the set position of the wellbore packer, and wherein, in response to increased uphole tensile force on the body, the shear sub is to shear the shear screw and move uphole relative to the bottom sub, and unset the wellbore packer from the set position.

5. The wellbore packer of claim 4, wherein the threaded hole comprises multiple threaded holes, and wherein the threaded hole to receive a shear screw of variable shear strength comprises the multiple threaded holes to receive a variable number of shear screws to vary the shear strength.

6. The wellbore packer of claim 4, further comprising a pump out plug to connect to a downhole portion of the shear sub in the set position.

7. The wellbore packer of claim 6, wherein the depression comprises a first depression and the shear screw comprises a first shear screw;

wherein the pump out plug is to connect to the downhole portion of the shear sub with a second shear screw;

wherein the shear sub has a threaded hole through a wall of the shear sub to receive the second shear screw, and wherein the pump out plug has a second depression in a wall of the pump out plug, with a head of the second shear screw to be positioned in the second depression in the set position.

8. The wellbore packer of claim 7, wherein hydraulic pressure from uphole is to shear the second shear screw to remove the pump out plug from the wellbore packer.

9. The wellbore packer of claim 6, wherein the pump out plug is to prevent hydraulic communication above and below the wellbore packer in the set position, and wherein removal of the pump out plug is to establish hydraulic communication through the wellbore packer.

10. The wellbore packer of claim 1, wherein the depression comprises a groove.

11. The wellbore packer of claim 1, wherein the depression comprises a slot or a spot face.

12. The wellbore packer of claim 1, further comprising:

a compressive element to compress in the set position and decompress after the shear release releases.

13. The wellbore packer of claim 1, further comprising:

a body lock ring (BLR), the BLR to ratchet against the body as the body moves uphole.

14. The wellbore packer of claim 1, wherein, in response to the increased uphole tensile force on the body, a body retrieval ring on an outside surface of the body is to shoulder on an upper cone of the wellbore packer, the upper cone is then to shoulder on a slip cage of the wellbore packer, and the shear sub is to shoulder to the bottom sub.

15. The wellbore packer of claim 1, wherein, in response to the increased uphole tensile force on the body, a slip cage shoulders on a slip, and the slip moves radially inward and uphole relative to a casing within which the wellbore packer is positioned.

16. The wellbore packer of claim 1, further comprising:

a bidirectional slip having anchor cones on both an uphole direction and a downhole direction of the slip to allow anchoring above in both the uphole direction and the downhole direction.

* * * * *